US006636706B2

(12) United States Patent
Chadani et al.

(10) Patent No.: US 6,636,706 B2
(45) Date of Patent: Oct. 21, 2003

(54) ELECTROPHOTOGRAPHIC IMAGE FORMING APPARATUS

(75) Inventors: Kazuo Chadani, Shizuoka (JP); Daisuke Abe, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/127,450

(22) Filed: Apr. 23, 2002

(65) Prior Publication Data

US 2002/0159780 A1 Oct. 31, 2002

(30) Foreign Application Priority Data

Apr. 27, 2001 (JP) ..... 2001-131702
Apr. 27, 2001 (JP) ..... 2001-132564

(51) Int. Cl.[7] ..... G03G 15/08

(52) U.S. Cl. ..... 399/27; 399/61; 399/62; 399/63; 399/30

(58) Field of Search ..... 399/27, 61, 62, 399/63, 64, 65, 9, 24, 25, 30; 118/694

(56) References Cited

U.S. PATENT DOCUMENTS 6,253,036 B1 6/2001 Karakama et al. ..... 399/27
6,415,111 B1 * 7/2002 Higeta ..... 399/27
6,505,008 B2 * 1/2003 Abe ..... 399/27

FOREIGN PATENT DOCUMENTS

JP 5-100571 4/1993

* cited by examiner

*Primary Examiner*—Hoang Ngo
(74) *Attorney, Agent, or Firm*—Fitzpatrick, Cella, Harper & Scinto

(57) ABSTRACT

In a detection unit, a measurement electrode member is arranged at a position where it contacts a developer, and has an input electrode for receiving a voltage from an apparatus main body and an output electrode for outputting an electrical signal in accordance with an electrostatic capacitance generated upon application of the voltage. A reference electrode member is arranged at a position where it does not contact the developer, and has an input electrode for receiving a voltage from the apparatus main body and an output electrode for outputting an electrical signal in accordance with an electrostatic capacitance generated upon application of the voltage. The measurement electrode member is adhered to an adhesion member. A lid member is coupled to the adhesion member and covers the reference electrode member. An engaging portion engages with a vessel positioning portion attached to the developer vessel, and positions the detection unit with respect to the developer vessel. A developer vessel, process cartridge, developing cartridge, and electrophotographic image forming apparatus are also disclosed.

20 Claims, 30 Drawing Sheets

ELECTROPHOTOGRAPHIC IMAGE FORMING APPARATUS

BACKGROUND OF THE INVENTION

1. Field of the Invention

The present invention relates to a detection unit for detecting the residual amount of developer, and a developer vessel, a developing cartridge, and a process cartridge, which use the detection unit respectively, and an electrophotographic image forming apparatus to which the process cartridge is detachably attachable.

2. Related Background Art

The electrophotographic image forming apparatus forms an image on a recording medium by using an electrophotographic image forming method. Examples of the electrophotographic image forming apparatus are an electrophotographic copying machine, electrophotographic printer (e.g., laser beam printer or LED printer), a facsimile apparatus, and a word processor.

The process cartridge is a cartridge which is an integral unit of at least a developing member and electrophotographic photosensitive drum and is detachably attachable to the main body of the electrophotographic image forming apparatus.

A conventional electrophotographic image forming apparatus using an electrophotographic image forming process adopts a process cartridge method in which an electrophotographic photosensitive member and a process means which acts on the electrophotographic photosensitive member are integrated into a cartridge and this cartridge is detachably attachable to the main body of the image forming apparatus. According to the process cartridge method, the apparatus can be maintained not by the serviceman but by the user, greatly improving the operability. This process cartridge method is widely used in image forming apparatuses.

The process cartridge forms an image on a recording medium with a developer, and consumes the developer every time an image is formed.

Some image forming apparatuses comprise a developer amount detection device which notifies the user that the developer has run out.

A conventional developer amount detection device has two electrode bars within the developer vessel of a developing member, and detects a change in electrostatic capacitance between the two electrode bars to detect the developer.

Japanese Patent Application Laid-Open No. 5-100571 discloses a developer amount detection device having a developer detection electrode member which is obtained by interdigitating, in concavo-convex form, two electrodes arranged parallel to each other at a predetermined interval on the same plane, instead of two electrode bars, and is set on the lower surface of the developer vessel. This apparatus detects the residual amount of developer by detecting a change in electrostatic capacitance between the parallel electrodes set in the flat state.

U.S. Pat. No. 6,253,036 discloses a detection device which sequentially detects the residual amount of developer by using an electrode member obtained by interdigitating, in concavo-convex form, two electrodes arranged parallel to each other at a predetermined interval on the same plane.

FIG. 25 shows attachment of a detection member 20 for sequentially detecting the residual amount of developer. An adhesion surface 29*c* for the detection member 20 is flat, and the detection member 20 is adhered to the entire adhesion surface 29*c*. If this arrangement is left at high temperatures and high humidities, the adhesive of the detection member 20 may float from the adhesion surface to generate bubbles. This phenomenon occurs due to a large adhesion area. Generated bubbles allow the toner to flow into the backside of the detection member 20, or change tight contact with the adhesion surface. As a result, the electrostatic capacitance detected by the detection member 20 varies.

The arrangement shown in FIG. 25 is devised under the development of the present invention, therefore is not a prior art.

SUMMARY OF THE INVENTION

It is an object of the present invention to provide a process cartridge, a developing cartridge, a developer vessel, and a detection unit, which are capable of accurately detecting the residual amount of developer, and an electrophotographic image forming apparatus to which the process cartridge is detachably attachable, and an electrophotographic image forming apparatus to which the developing cartridge is detachably attachable.

It is another object of the present invention to provide a process cartridge, a developing cartridge, a developer vessel, and a detection unit, which are capable of preventing a developer from attaching to the reference electrode member of a detection unit, and an electrophotographic image forming apparatus to which the process cartridge is detachably attachable, and an electrophotographic image forming apparatus to which the developing cartridge is detachably attachable.

It is still another object of the present invention to provide a process cartridge, a developing cartridge, a developer vessel, and a detection unit, which are capable of reliably adhering a measurement electrode member to an adhesion member, and an electrophotographic image forming apparatus to which the process cartridge is detachably attachable, and an electrophotographic image forming apparatus to which the developing cartridge is detachably attachable.

It is still another object of the present invention to provide a process cartridge, a developing cartridge, a developer vessel, and a detection unit, which are capable of reliably adhering the reference electrode member to the adhesion member, and an electrophotographic image forming apparatus to which the process cartridge is detachably attachable, and an electrophotographic image forming apparatus to which the developing cartridge is detachably attachable.

It is still another object of the present invention to provide a process cartridge, a developing cartridge, a developer vessel, and a detection unit, which are capable of easily positioning a detection unit for detecting the residual amount of developer within a developer vessel with respect to the developer vessel, thereby increasing the assembly precision, and an electrophotographic image forming apparatus to which the process cartridge is detachably attachable, and an electrophotographic image forming apparatus to which the developing cartridge is detachably attachable.

According to an aspect of the present invention, there are provided: a detection unit for outputting an electrical signal in accordance with an electrostatic capacitance to an apparatus main body in order to detect a residual amount of developer in an electrophotographic image forming apparatus main body, comprising:

a measurement electrode member which is arranged at a position where the measurement electrode member contacts the developer when mounted in the developer vessel, has at least a pair of portions parallel to each other at a predetermined interval, and has an input electrode for receiving a voltage from the apparatus main body and an output electrode for outputting an electrical signal in accordance with an electrostatic capacitance generated upon application of the voltage;

a reference electrode member which is arranged at a position where the reference electrode member does not contact the developer when mounted in the developer vessel, has at least a pair of portions parallel to each other at a predetermined interval, and has an input electrode for receiving a voltage from the apparatus main body and an output electrode for outputting an electrical signal in accordance with an electrostatic capacitance generated upon application of the voltage;

an adhesion member to which the measurement electrode member is adhered;

a lid member which is coupled to the adhesion member and covers the reference electrode member interposed between the adhesion member and the lid member; and an engaging portion which engages with a vessel positioning portion when the detection unit is attached to the developer vessel, and positions the detection unit with respect to the developer vessel, and a developer vessel, a developing cartridge, and a process cartridge, using the detection unit which use the detection unit respectively, and an electrophotographic image forming apparatus to which the process cartridge is detachably attachable.

DETAILED DESCRIPTION OF THE PREFERRED EMBODIMENTS

First Embodiment

Description of Process Cartridge and Image Forming Apparatus Main Body

A process cartridge and electrophotographic image forming apparatus according to the present invention will be described in detail below with reference to the accompanying drawings.

Figure 1:
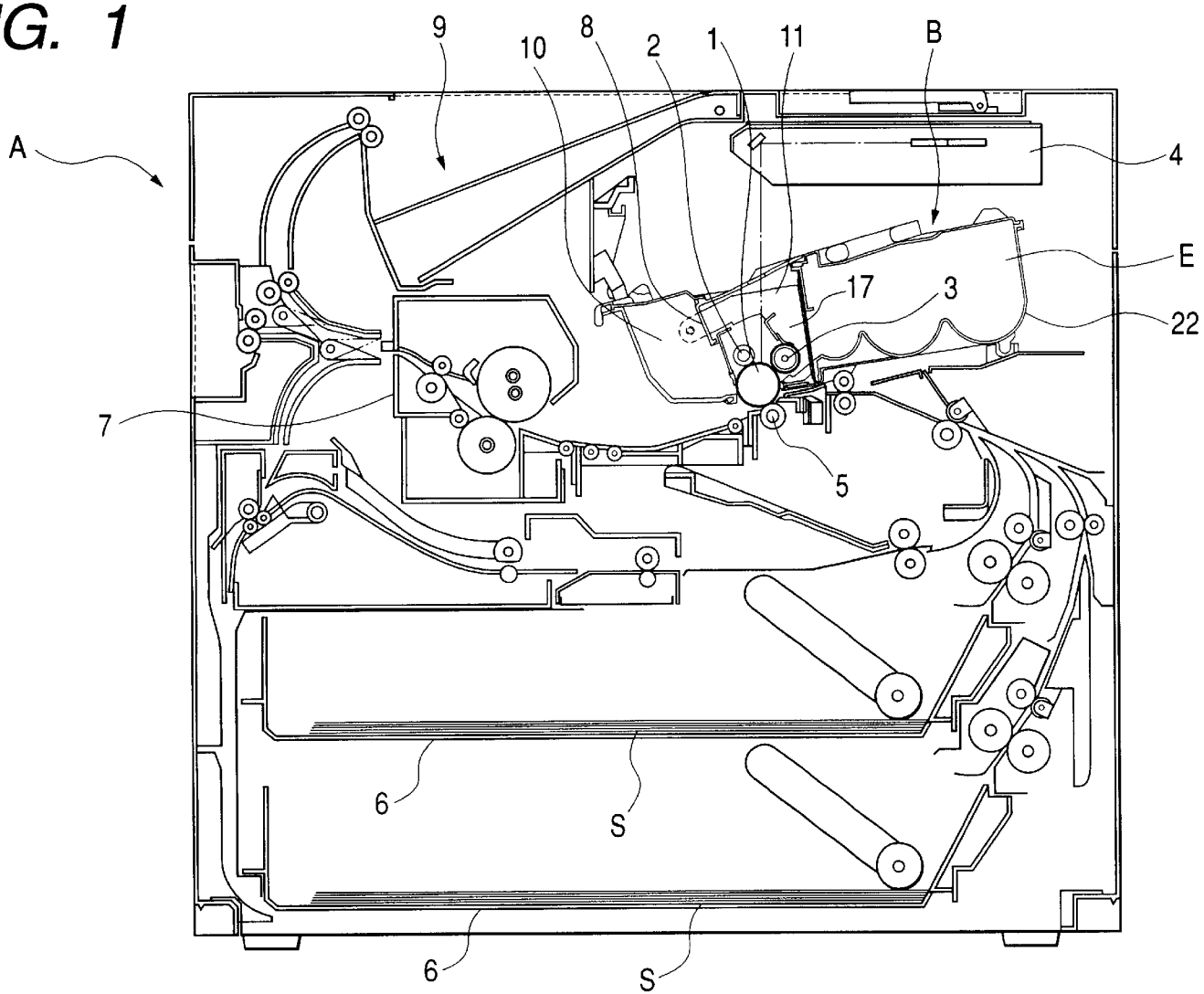
FIG. 1 is a longitudinal sectional view showing an electrophotographic image forming apparatus according to the present invention.

FIG. 1 is a sectional view showing a process cartridge and image forming apparatus according to the first embodiment.

A process cartridge B is constituted by integrating a developing unit joined to a developer vessel E, and a developing frame 11 which includes a photosensitive drum 1, an electrostatic charging means 2 for uniformly charging the surface of the photosensitive drum 1, a cleaning unit obtained by integrating a cleaning means 8 to a cleaning vessel 10, a developing roller 3 serving as a developing member which faces the photosensitive drum 1, and a developer regulation member 17 for regulating the toner amount on the developing roller 3.

In a laser printer A serving as an image forming apparatus, a laser scanner 4 for emitting a laser beam in correspondence with image information is disposed above the process cartridge B, and a transferring means 5 which faces the photosensitive drum 1 is disposed below the process cartridge B.

In this arrangement, image formation is performed as follows. The photosensitive drum 1 is uniformly charged by the electrostatic charging means 2. The surface of the photosensitive drum 1 is scanned by and exposed to a laser beam emitted by the laser scanner 4 to form an electrostatic latent image of target image information. The electrostatic latent image is visualized as an image by depositing a developer in the developing frame 11 by the operation of the developing roller 3. As the developer, the first embodiment uses an insulating developer containing one magnetic component. The image on the photosensitive drum 1 is transferred by the transferring means 5 onto a recording sheet S serving as a recording medium fed and conveyed from a sheet cassette 6. The recording sheet S passes through a fixing means 7 to fix the image onto the recording sheet S. Then, the recording sheet S is discharged onto a sheet discharge tray 9 outside the image forming apparatus main body (to be referred to as an apparatus main body hereinafter). After the developer image is transferred onto the recording sheet S, the developer left on the photosensitive drum 1 is removed by the cleaning means 8 and collected in the cleaning vessel 10.

Figure 24:
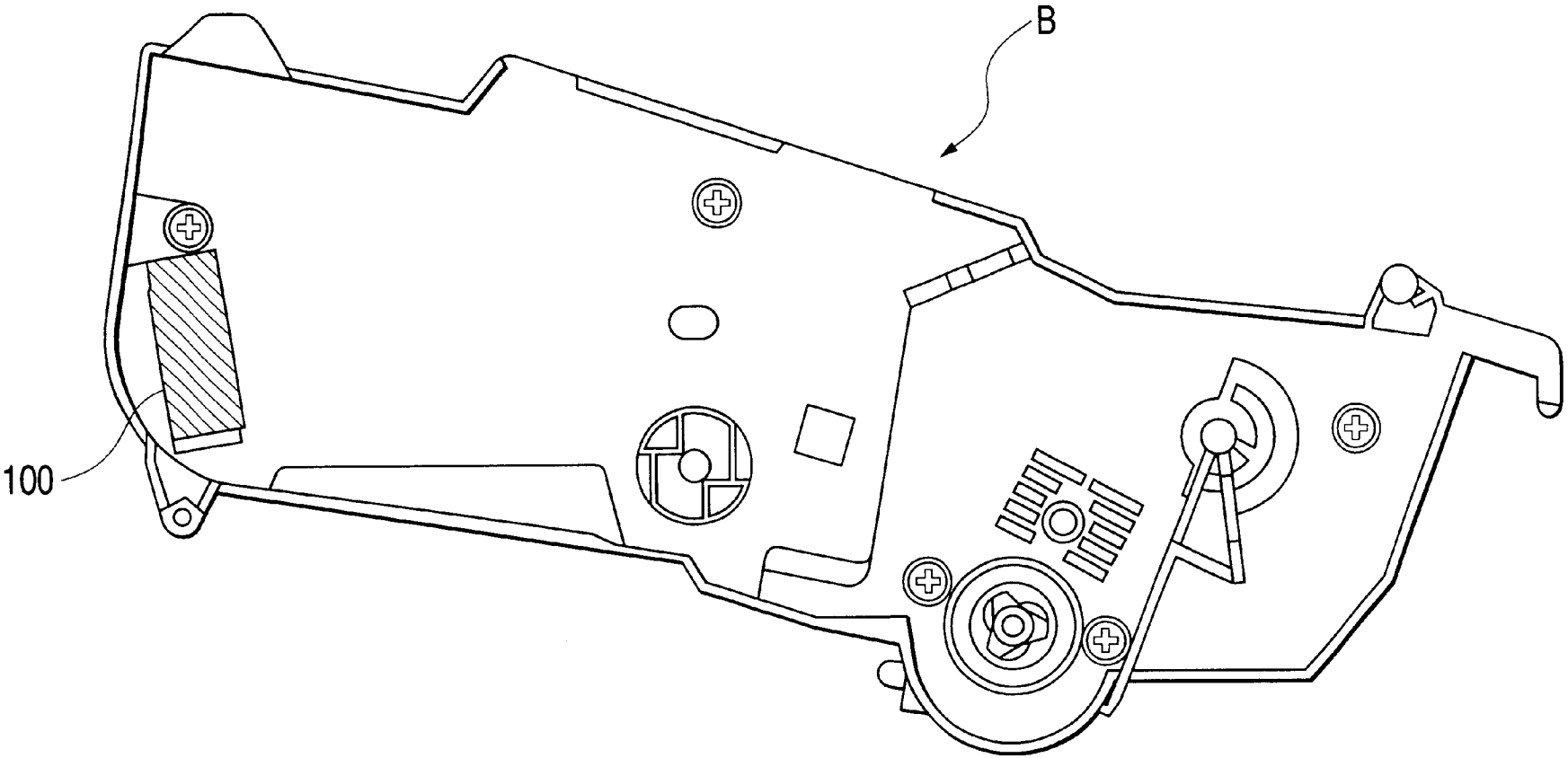
FIG. 24 is a plan view for explaining the layout of a memory unit in the present invention.
Figure 25:
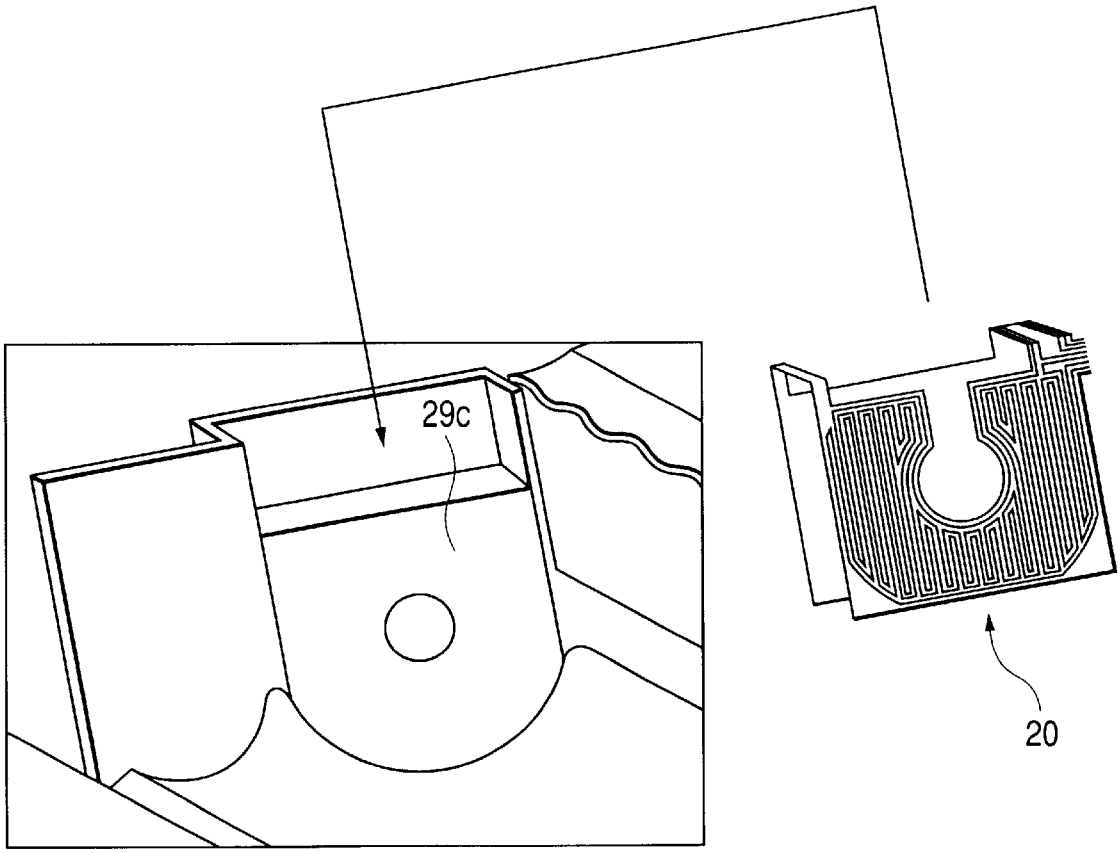
FIG. 25 is a perspective view showing the adhesion surface of a detection means (not a prior art) devised under the development of the present invention.

The process cartridge B comprises a memory unit serving as a storage device. FIG. 24 is a view showing the position of a memory unit 100 mounted in the process cartridge B.

The memory unit 100 is mounted inside the side surface of the process cartridge B.

Overall System Configuration

The system configuration of the image forming apparatus according to the first embodiment will be explained with reference to the system block diagram of FIG. 21.

An engine controller 50 controls the system of the whole image forming apparatus. The engine controller 50 incorporates a CPU (Central Processing Unit: not shown). A series of system processes in the image forming apparatus are performed in accordance with programs stored in advance in the CPU. A high voltage power supply 51 generates an electrostatic charging bias prepared by superposing an AC voltage on a DC voltage for the electrostatic charging means 2, a developing bias prepared by superposing an AC voltage on a DC voltage for the developing roller 3, a transferring bias as a DC voltage for the transferring means 5, and a fixing bias as a DC voltage for the fixing means 7. A drive portion 52 includes a motor, solenoid, and the like in the apparatus. Sensors 53 are arranged at predetermined positions in the image forming apparatus. A display portion 54 displays the state of the apparatus. Toner amount detection device A 55 and toner amount detection device B 49 detect the electrostatic capacitances of developer detection members in the process cartridge.

A memory control circuit 56 controls the memory unit 100 mounted in the process cartridge B.

Description of Memory Unit

The memory unit 100 will be explained.

The memory unit 100 incorporates a nonvolatile memory element, and can write and read out data by data communication with the image forming apparatus.

Data communication is entirely controlled by the memory control circuit 56.

Data communication is performed in a non-contact manner by magnetic coupling between an antenna in the memory unit 100 and an antenna (not shown) in the image forming apparatus. When the process cartridge B is mounted in the laser printer A, the antenna of the memory unit 100 comes close to the antenna of the laser printer A to enable communication.

The memory unit 100 incorporates a power supply circuit, which supplies all the internally used DC powers. The power supply circuit generates a DC voltage by rectifying a current generated in the antenna by magnetic coupling of the two antennas.

The memory unit 100 stores information concerning the process cartridge and the like.

Arrangement of Process Cartridge

Figure 2:
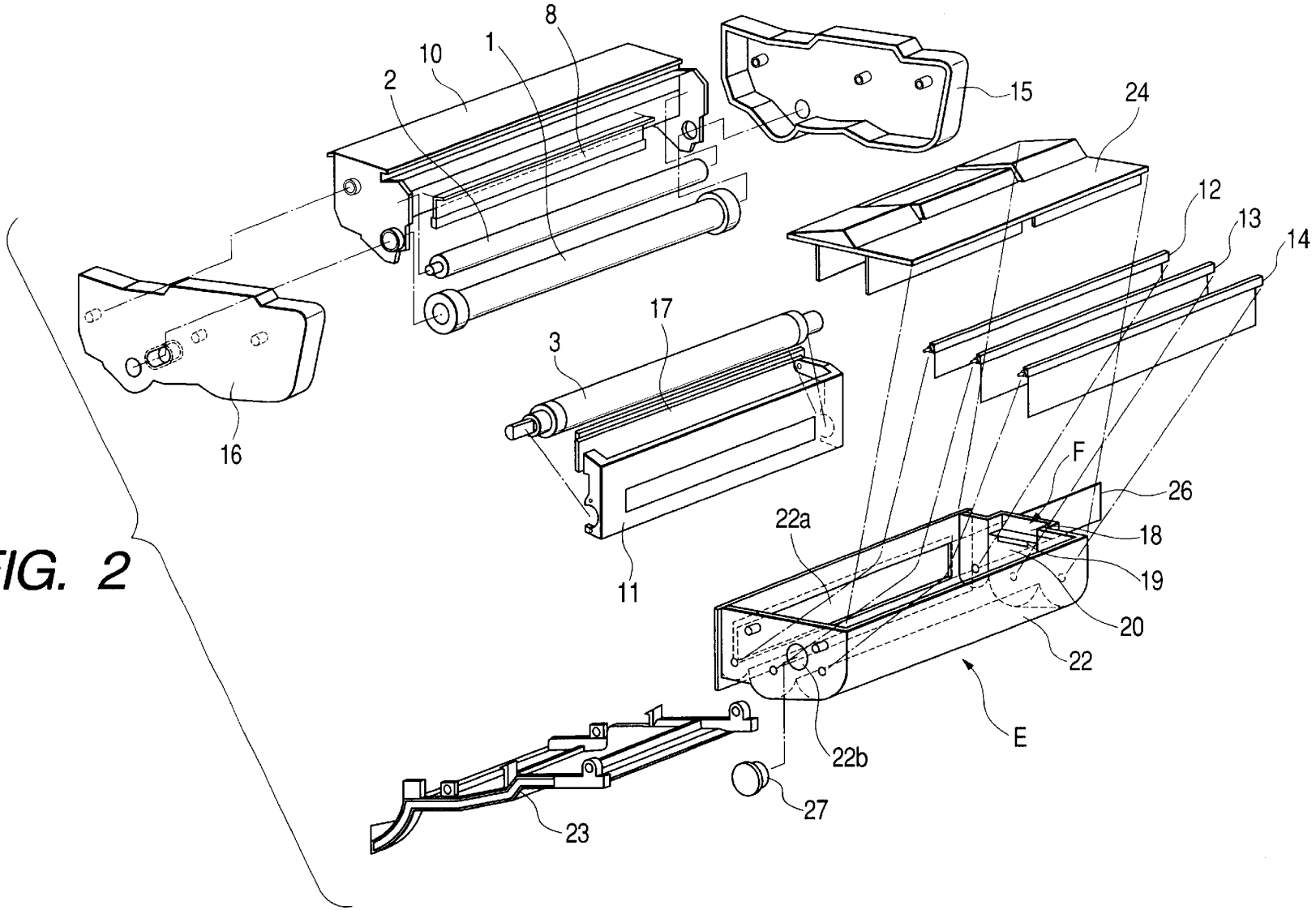
FIG. 2 is an exploded perspective view showing the arrangement of a process cartridge according to the present invention.
Figure 3:
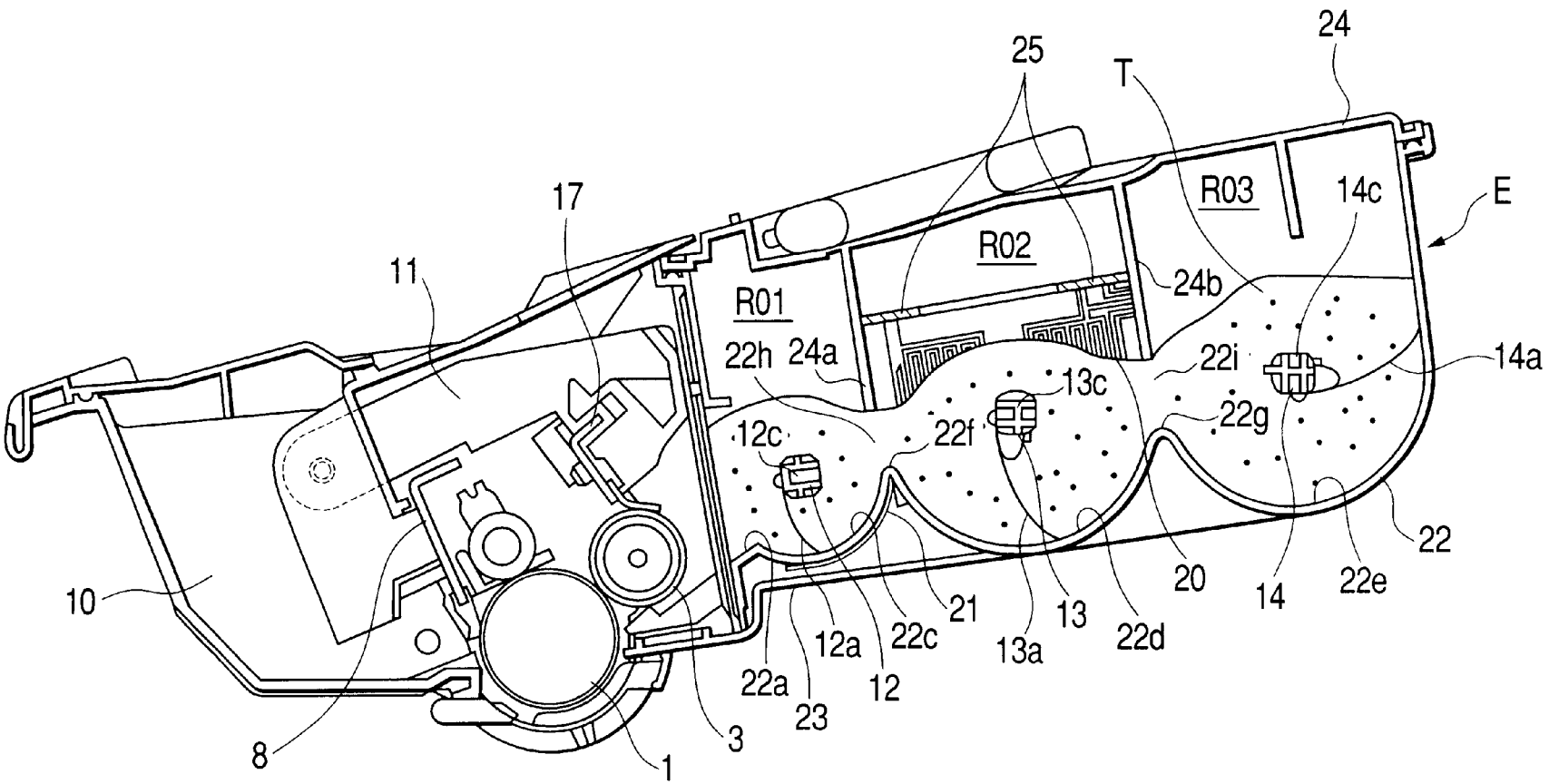
FIG. 3 is a longitudinal sectional view showing the process cartridge according to the present invention.
Figure 4A:
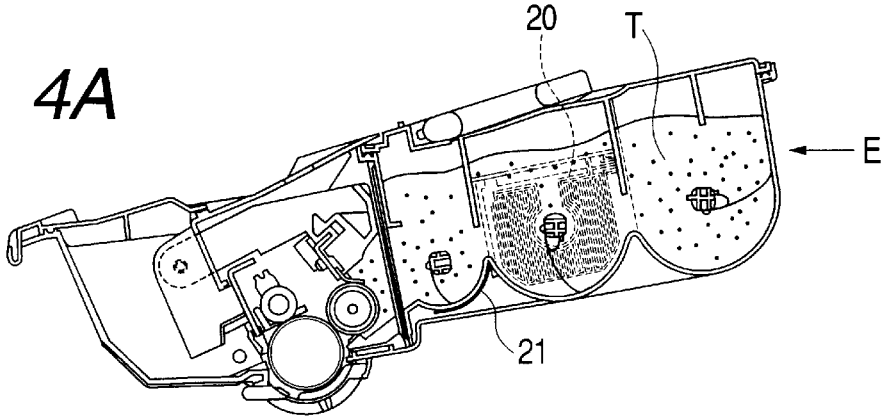
FIGS. 4A, 4B, 4C and 4D are longitudinal sectional views of a developer vessel showing the consumption of a developer.
Figure 4B:
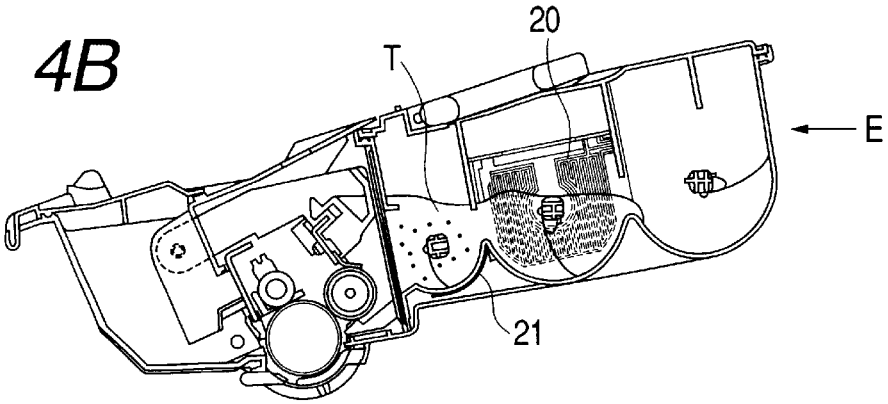
Figure 4C:
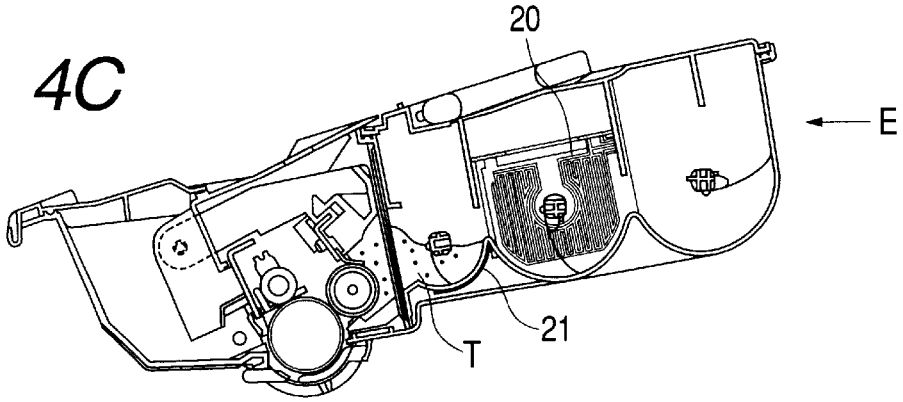
Figure 4D:
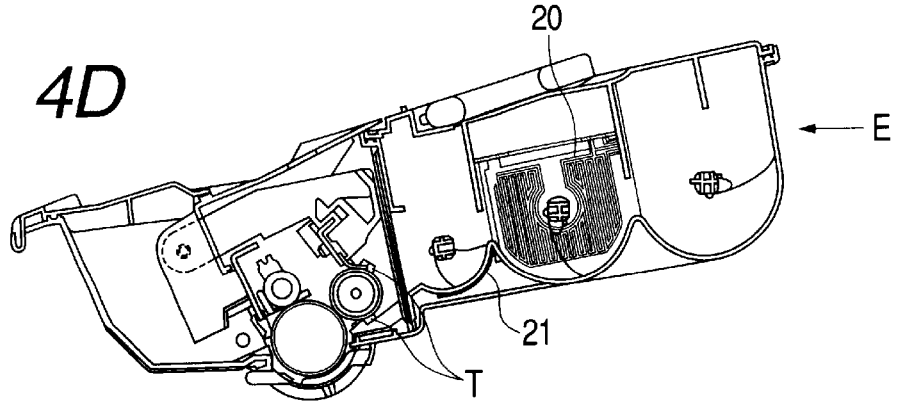

FIG. 2 is an exploded perspective view showing a process cartridge according to the first embodiment. FIG. 3 is a sectional view showing the process cartridge.

In FIG. 2, the process cartridge of the first embodiment is constituted by the developer vessel E which stores a developer, the developing frame 11 which holds the developing member, the cleaning vessel 10 which holds the photosensitive drum 1 and cleaning means 8, side covers 15 and 16 which hold the developer vessel E and cleaning vessel 10, and a cover member 23 which covers a second detection member 21. The respective vessels are coupled into an integral cartridge by the side covers.

The developer vessel E has a developer storage vessel frame 22, agitation members 12, 13, and 14, a developer seal member 26, a developer storage vessel lid 24, a developer lid 27, and a detection unit F.

The vessel frame 22 has a discharge port 22*a* for discharging a developer in the vessel frame 22 to the developing roller 3. The removable developer seal member 26 is so attached as to seal the discharge port 22*a*. The detection unit F for detecting the developer amount in the developer vessel E is arranged in the vessel frame 22. The agitation members 12, 13, and 14 are rotatably attached to the vessel frame 22. After the agitation members 12, 13, and 14 and the detection unit F are assembled into the vessel frame 22, the vessel lid 24 closes the vessel frame 22 and is welded to it. A developer T is filled in the developer vessel from a filling port 22*b* formed in the side surface of the vessel frame 22, and the filling port 22*b* is closed with the developer lid 27.

In FIG. 3, the developer vessel E is horizontally elongated (long in the lateral direction in FIG. 3) to cope with a large capacity. Three recesses 22*c*, 22*d*, and 22*e* are formed in the bottom of the developer vessel E. The sectional shapes of the recesses 22*c*, 22*d*, and 22*e* are arcuate shapes centered on agitation bars 12*c*, 13*c*, and 14*c*. Driving force is transferred from the motor (not shown) of the apparatus main body to rotate the three agitation members 12, 13, and 14. The developer T is carried from the recesses 22*c*, 22*d*, and 22*e* of the vessel frame 22 to the developing frame 11 by agitation blades 12*a*, 13*a*, and 14*a* attached to the agitation members 12, 13, and 14. By horizontally elongating the developer vessel E, the weight of the developer T can be distributed. This can prevent fading, degradation in developer, an increase in agitation torque, and the like.

The agitation blades 12*a*, 13*a*, and 14*a* are formed from a resin sheet member made of polyethylene terephthalate, polyethylene sulfide, or the like. The rotation radii of the distal ends of the agitation blades 12*a*, 13*a*, and 14*a* are larger than the radii of the recesses 22*c*, 22*d*, and 22*e* of the vessel frame 22. The distal ends of the agitation blades 12*a*, 13*a*, and 14*a* contact the recesses 22*c*, 22*d*, and 22*e* while being flexed. The distal ends rub the bottoms of the recesses 22*c*, 22*d*, and 22*e* of the vessel frame 22, and respectively rotate clockwise in FIG. 3. As a result, the developer T is carried without leaving it on the bottom of the vessel frame 22.

Ribs 24*a* and 24*b* are vertically attached to the vessel lid 24 so as to face a peak portion 22*f* between the adjacent recesses 22*c* and 22*d* and a peak portion 22*g* between the adjacent recesses 22*d* and 22*e*. The ribs 24*a* and 24*b* are formed over almost the entire length of the vessel lid 24 in the longitudinal direction. The developer vessel E is partitioned into R01, R02, and R03. R01 and R02 communicate with each other via an opening 22*h*, whereas R2 and R3 communicate with each other via an opening 22*i*.

The developer is laterally carried as follows. The developer in R01 is supplied to the developing roller 3 via the discharge port 22*a* by the agitation member 12. The developer in R02 is supplied to R01 via the opening 22*h* by the agitation member 13. The developer in R03 is supplied to R02 via the opening 22*i* by the agitation member 14.

Outline of Developer Amount Detection Member

In FIG. 3, the detection unit F having the first detection member 20, and the second detection member 21 are arranged to sequentially detect the developer amount. The first detection member 20 is used to detect the developer T in a region where the amount of developer T is large. The second detection member 21 is used to detect the developer T in a region where the amount of developer T is small. More specifically, the first detection member 20 performs detection from the start of use of the developer to about 50% to about 10% of the developer amount. The second detection member 21 performs detection from about 50% to about 10% of the developer amount to the absence of the developer. The first and second detection members 20 and 21 both measure the developer by using electrostatic capacitances.

Figure 5:
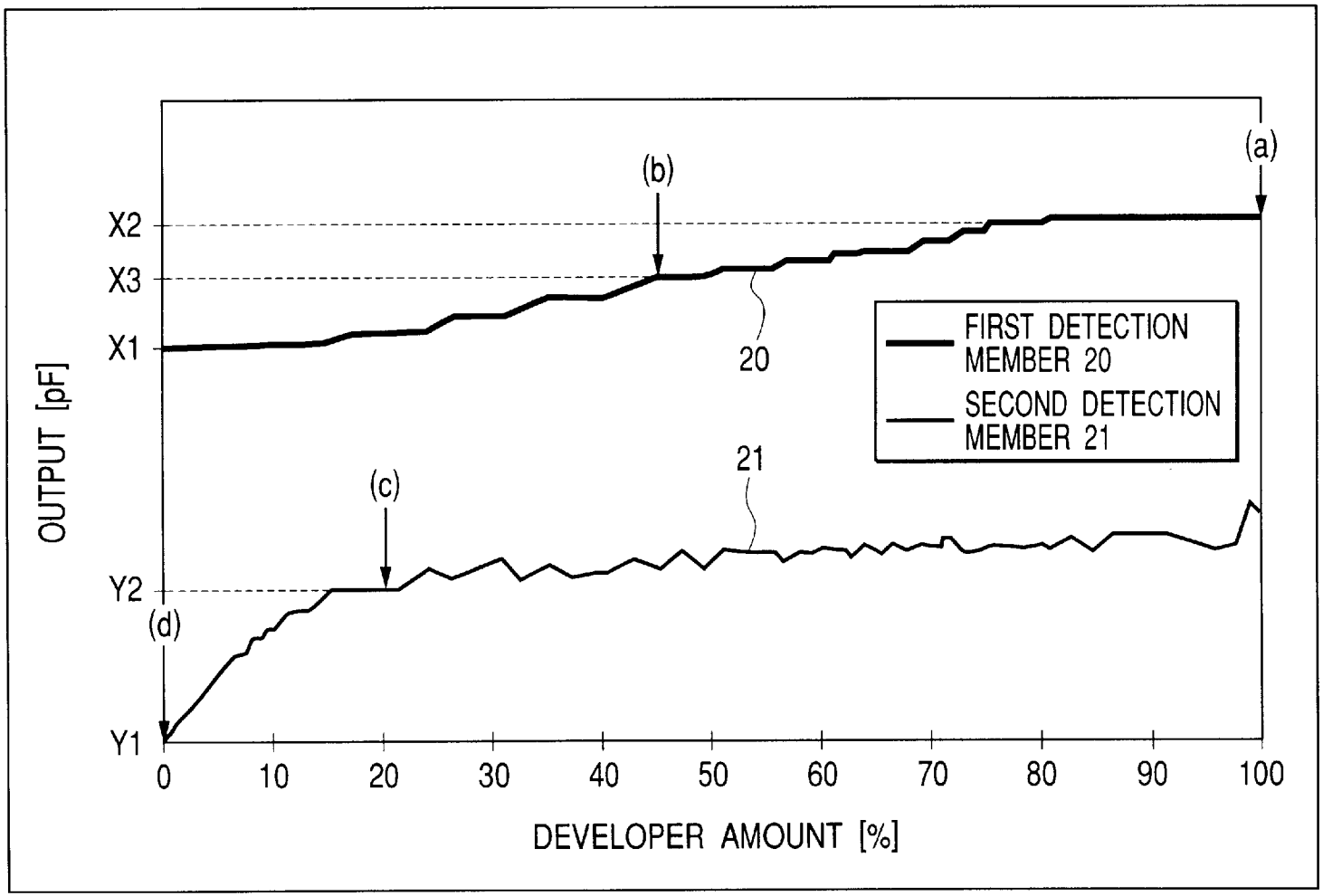
FIG. 5 is a graph showing the relationship between the developer amount and the electrostatic capacitance in a developer amount detection device according to the present invention.

FIGS. 4A to 4D show the transition of the developer, and FIG. 5 shows the relationship between the developer amount and the electrostatic capacitance. In the first embodiment, detection of the developer amount shifts from the first detection member 20 to the second detection member 21 when the developer amount decreases to about 20%. FIGS. 4A to 4D correspond to (a) to (d) in FIG. 5, respectively.

(a) When the developer amount is 100%, both the first and second detection members 20 and 21 are buried in the developer. At this time, the output from the first detection member 20 is X2. (b) As the developer is gradually consumed, the developer amount in the detection region of the first detection member 20 changes. The output changes along with a change in the developer area in contact with the surface of the first detection member 20. At this time, the output from the first detection member 20 is X3. (c) When the developer decreases to about 20%, the operation of the second detection member 21 starts. At this time, the output from the second detection member 21 is Y2. (d) Detection continues until the developer decreases to 0%. At this time, the output from the second detection member is Y1. Hence, the developer amount can be sequentially detected in all the regions from the start to end of the use of the process cartridge B.

Principle and Arrangement of First Detection Member

Figure 6:
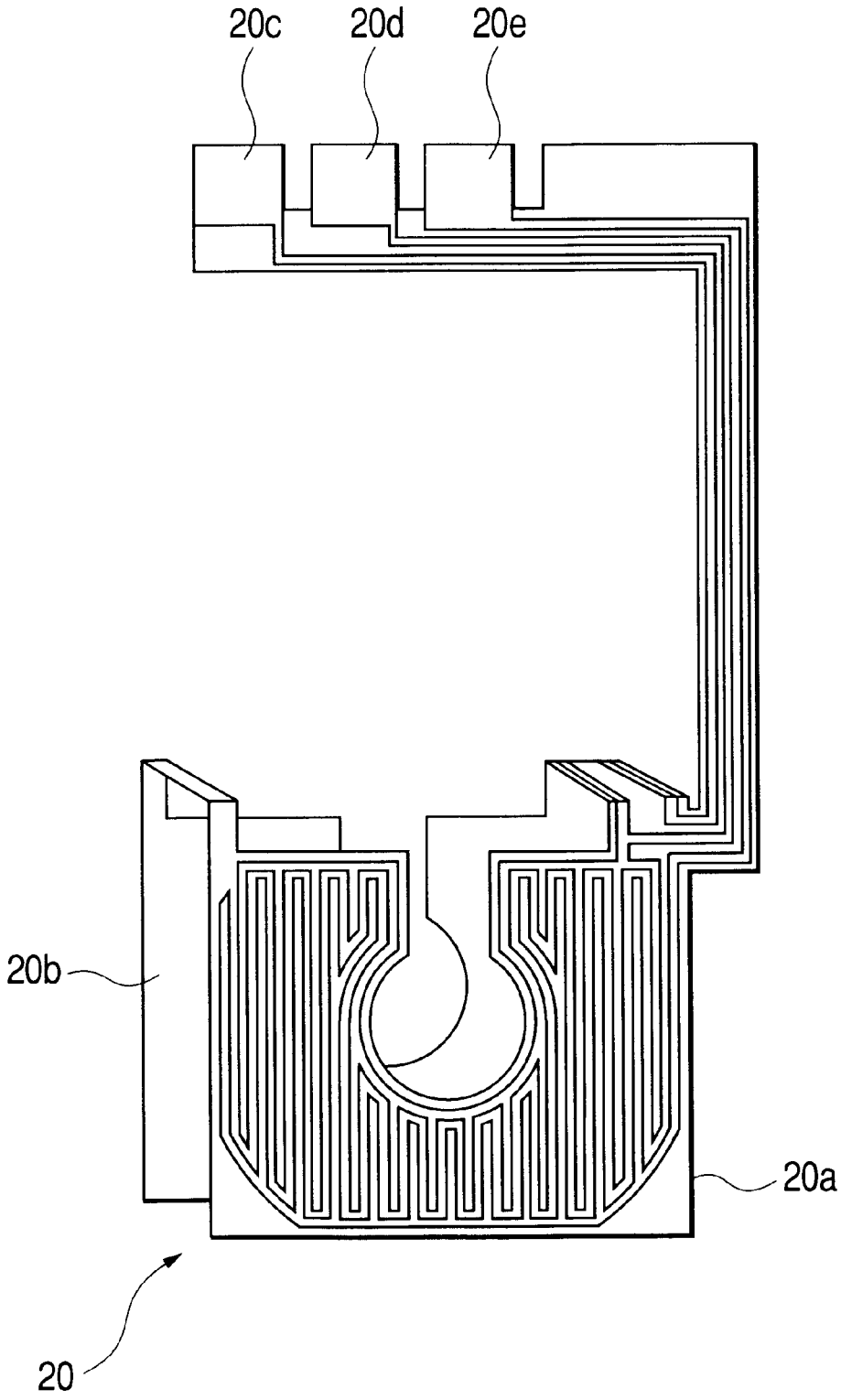
FIG. 6 is a perspective view showing the first detection member in the present invention.
Figure 7:
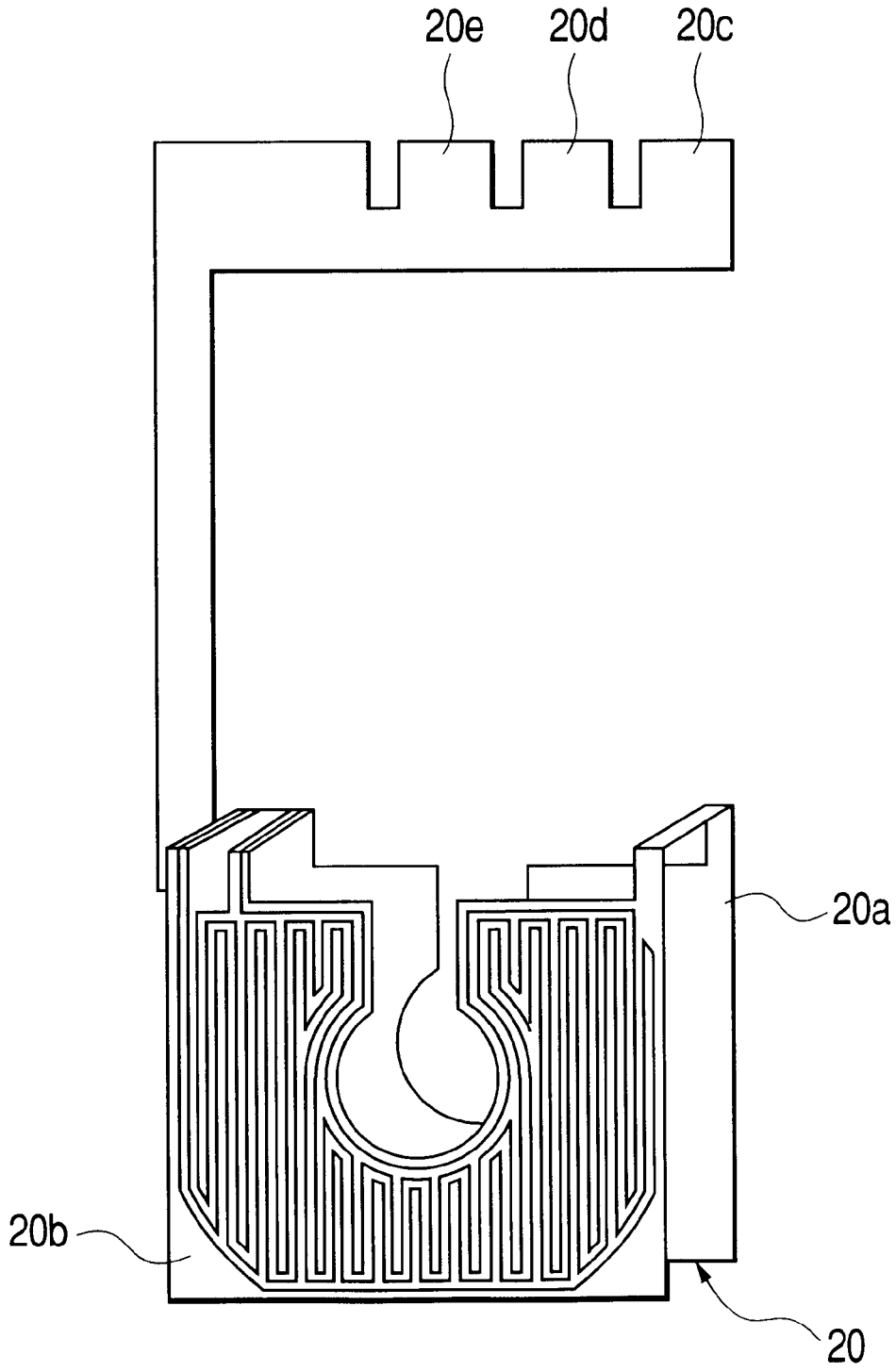
FIG. 7 is a perspective view showing the first detection member in the present invention.
Figure 8:
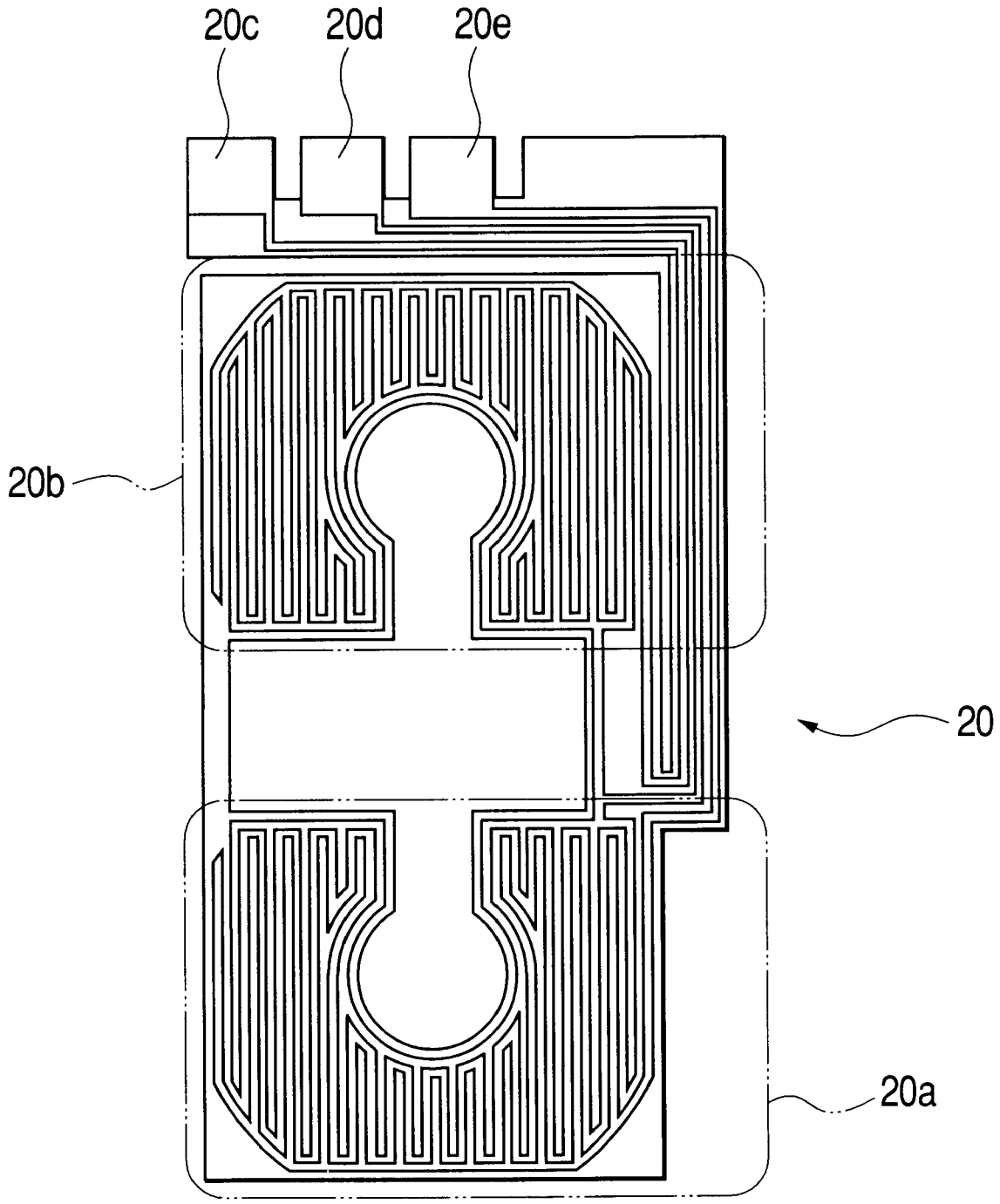
FIG. 8 is an exploded view showing the first detection member in the present invention.

The operation principle of each detection member will be explained. The first detection member is shown in FIG. 6. FIG. 7 is a view of the first detection member when viewed from a side opposite to FIG. 6. FIG. 8 is an exploded view of the first detection member 20.

In FIG. 8, the first detection member 20 has a measurement side output electrode 20*e*, reference side output electrode 20*c*, and common input electrode 20*d*. A combination of the measurement side output electrode 20*e* and common input electrode 20*d* is defined as a measurement electrode 20*a*. A combination of the reference side output electrode 20*c* and common input electrode 20*d* is defined as a reference electrode 20*b*. The measurement electrode 20*a* and reference electrode 20*b* are electrode members each of which detects the electrostatic capacitance between electrodes by input and output side electrodes formed parallel to each other on the same plane at a predetermined interval.

In FIGS. 6 and 7, the measurement electrode 20*a* is disposed at a position such as the internal side surface of the vessel frame 22 where the measurement electrode 20*a* contacts the developer. By measuring the electrostatic capacitance between the paired electrodes 20*e* and 20*d*, a change in developer area in contact with the electrode surface can be detected to detect the developer amount in the vessel frame 22. Since the permittivity of the developer is higher than that of air, a change in the surface area of the detection member in contact with the developer changes the electrostatic capacitance between the electrodes.

The reference electrode 20*b* is disposed at a position where it does not contact the developer even in the developer vessel E. The reference electrode 20*b* is designed such that the electrostatic capacitance changes similar to that of the measurement electrode 20*a* upon a change in environmental conditions. In the first embodiment, the measurement electrode 20*a* and reference electrode 20*b* have the same electrode pattern. By subtracting the electrostatic capacitance value of the reference electrode 20*b* from that of the measurement electrode 20*a*, a change in electrostatic capacitance depending on the environmental conditions can be regarded not to occur. This can increase the detection precision.

As shown in FIG. 8, the measurement electrode 20*a* and reference electrode 20*b* are preferably formed on one surface of one flexible board such as a flexible printed circuit. The first detection member 20 is bent and housed in the developer vessel. The edge or entire back surface of the first detection member 20 is fixed with an adhesive such as a double-coated tape so as to prevent the developer from entering the backside of the measurement electrode 20*a*.

Layout of First Detection Member

Figure 9:
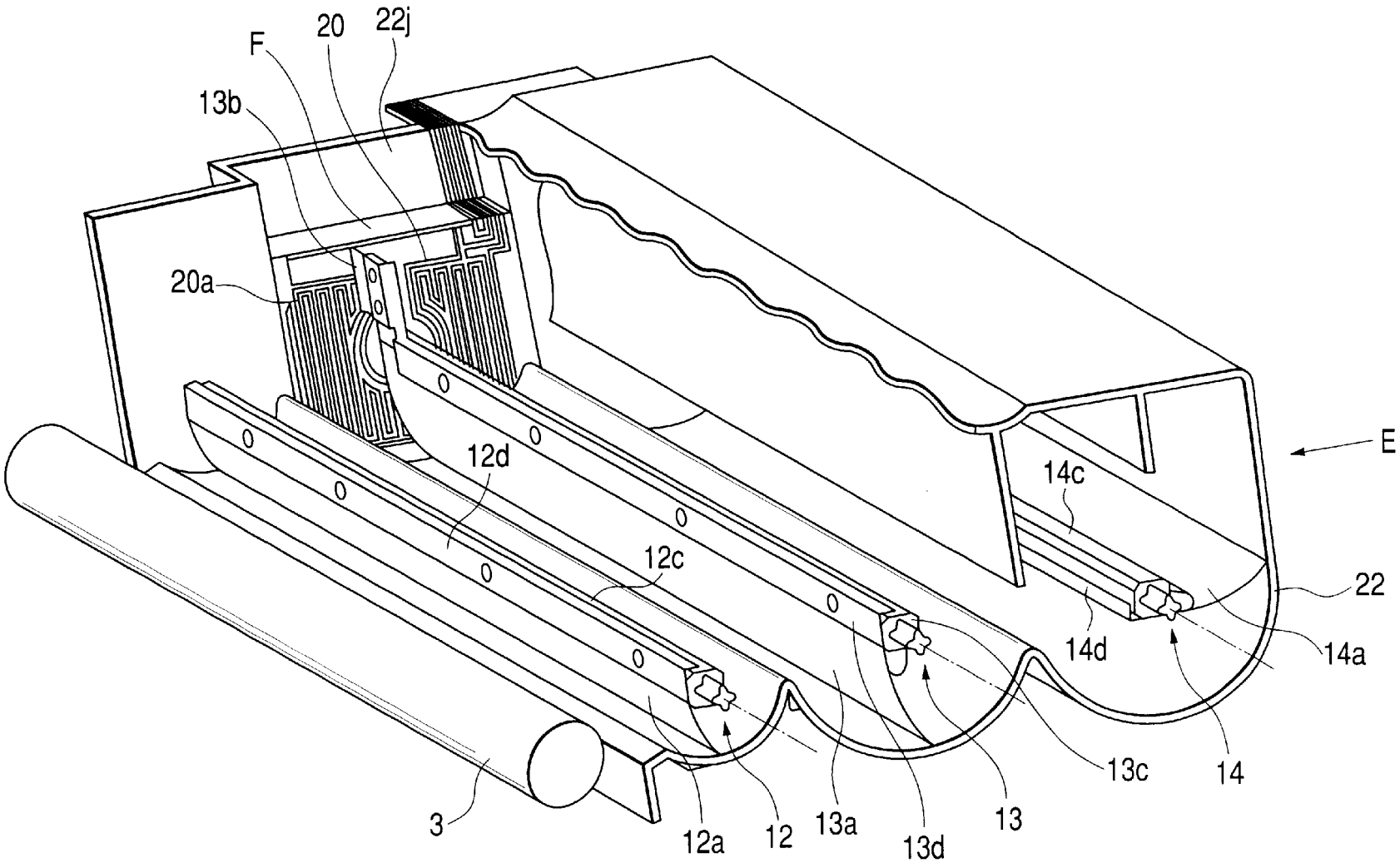
FIG. 9 is a perspective view showing the developer vessel in the present invention.

FIG. 9 is a perspective view showing the developer vessel E. The detection unit F having the first detection member 20 is laid out on a side wall 22*j* of R02 on the drive side from which the developer is supplied to R01 serving as the operation region of the second detection member. The first detection member 20 is located at a position where it surrounds the agitation bar 13*c* of the agitation member 13. Gears are respectively fixed to the agitation bars 12*c*, 13*c*, and 14*c* outside the side wall 22*j*. The gears are coupled to each other via idler gears to transfer driving from the apparatus main body (not shown). By laying out the detection unit F at this position, the developer amount can be sequentially detected. The area of the first detection member 20 can be decreased, and thus the component cost can be decreased. By spacing the first detection member 20 apart from the developing roller 3, the influence of the developing bias can be reduced.

Arrangement of Wiping Member

In the first embodiment, the developer agitation member 13 has a surface wiping member 13*b* as a developer removal means for removing the developer attached to the detection region of the first detection member 20. The wiping member 13*b* is arranged at only a portion of the agitation member 13 where the first detection member 20 is disposed (see FIG. 9).

The developer agitation member 13 is constituted by the agitation bar 13*c*, the agitation blade 13*a*, an agitation blade press member 13*d*, and the wiping member 13*b*. The agitation bar 13*c* is rotatably supported by the vessel frame 22. The agitation blade 13*a* is pressed against the agitation bar 13*c* by the agitation blade press member 13*d* and fixed to the agitation bar 13*c*. The agitation blade press member 13*d* is formed from a metal plate or resin, and fixed to the agitation bar 13*c* by thermal calking, ultrasonic welding, adhesion, or the like. The wiping member 13*b* is also fixed by the agitation blade press member 13*d*, similar to the agitation blade 13*a*. The agitation blade 13*a* is formed from a resin material such as polyethylene terephthalate or polyethylene sulfide. The wiping member 13*b* can be formed from a resin sheet member made of polyethylene terephthalate or polyethylene sulfide, or may be formed from a rubber or foamed member. The same function can be attained as far as the material is suitable for wiping the surface of the first detection member 20.

In the remaining agitation members 12 and 14, the agitation blades 12*a* and 14*a* are fixed to the agitation bars 12*a* and 14*c* by agitation bar press members 12*d* and 14*d*.

Figure 10:
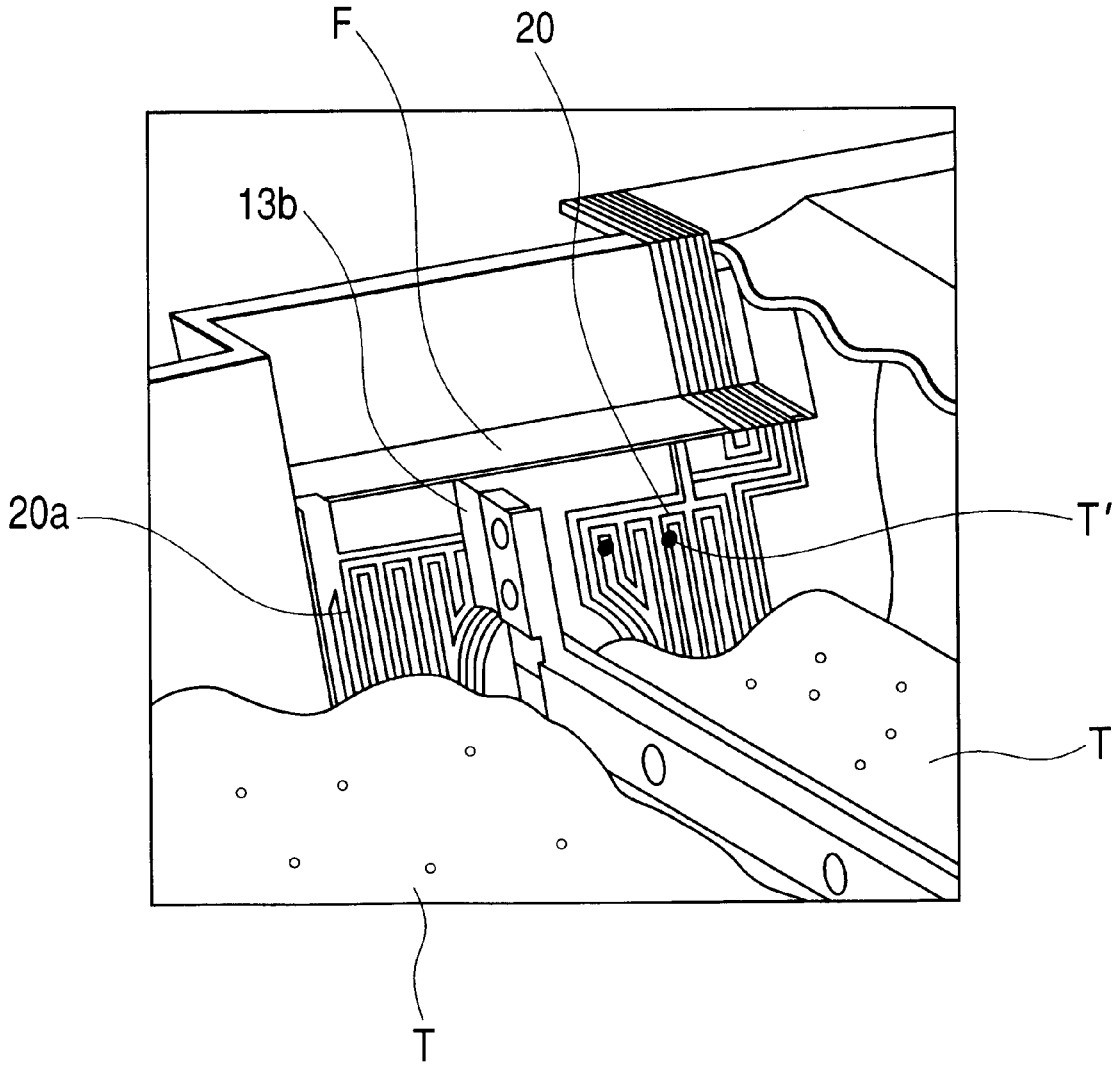
FIG. 10 is a perspective view showing the state of a wiping member in the present invention.

FIG. 10 is a perspective view showing the first detection member 20 when the developer is consumed to some degree. A developer T' attached to the first detection member 20 exists above the developer level. The presence of the attached developer T increases the electrostatic capacitance of the measurement electrode 20*a*, which generates unevenness and inhibits accurately detecting the developer amount. To prevent this, the first measurement electrode 20*a* can be wiped by the wiping member 13*b* to remove the developer attached above the developer level. The developer amount can be accurately detected.

Arrangement of Detection Unit

Figure 13:
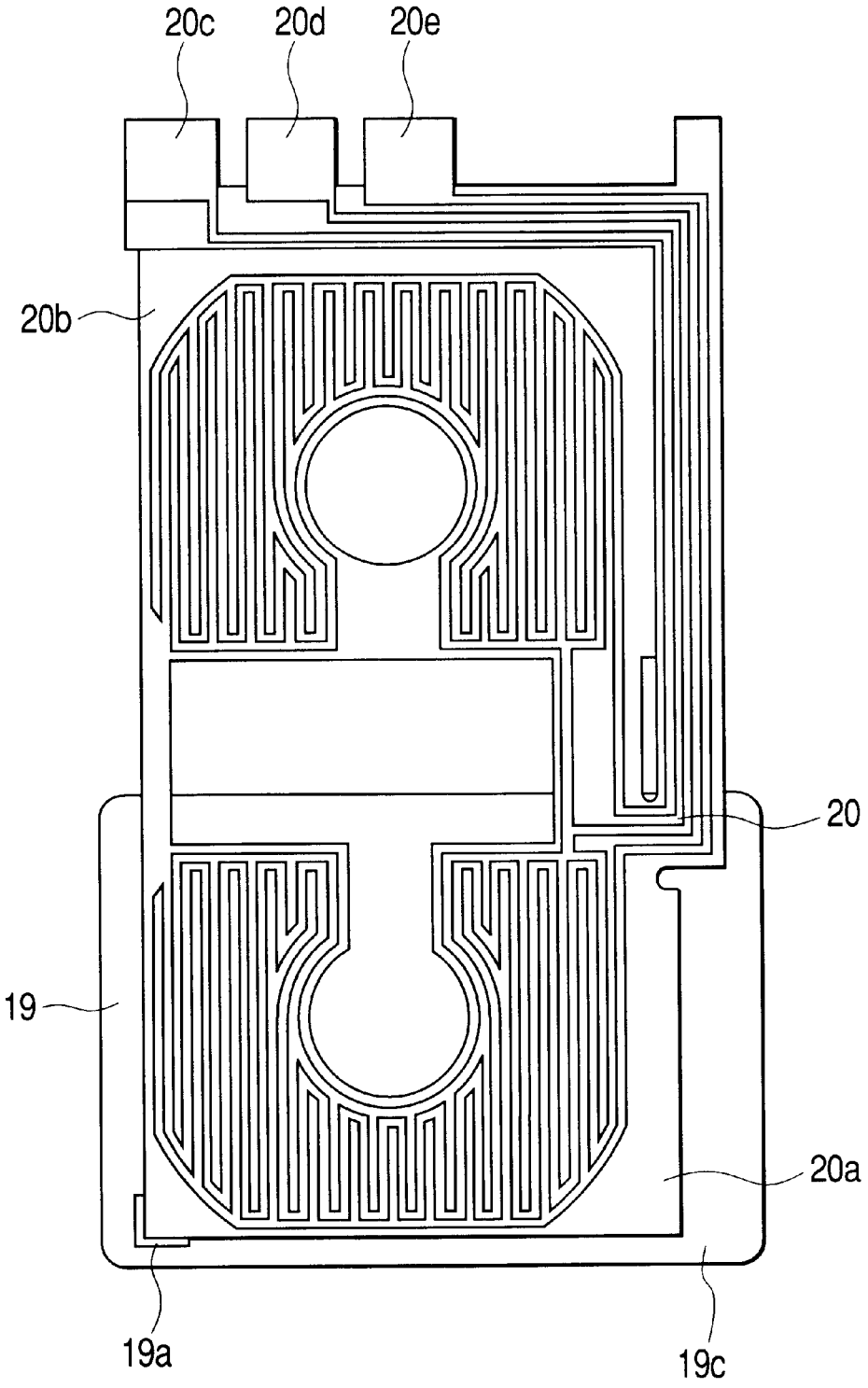
FIG. 13 is a front view showing the first detection member adhered to an adhesion member in the present invention.
Figure 14:
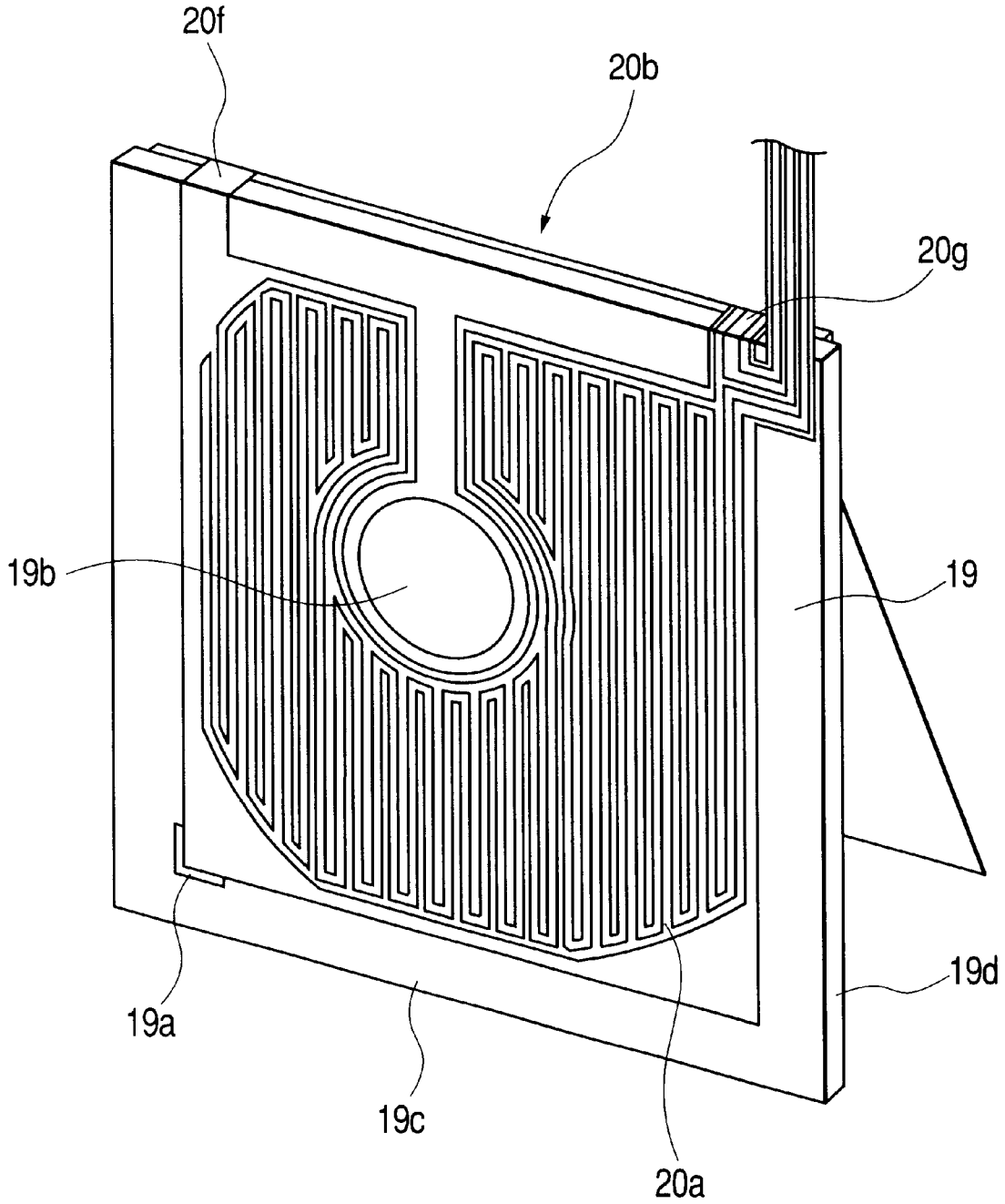
FIG. 14 is a perspective view showing the first detection member adhered to the adhesion member in the present invention.
Figure 15:
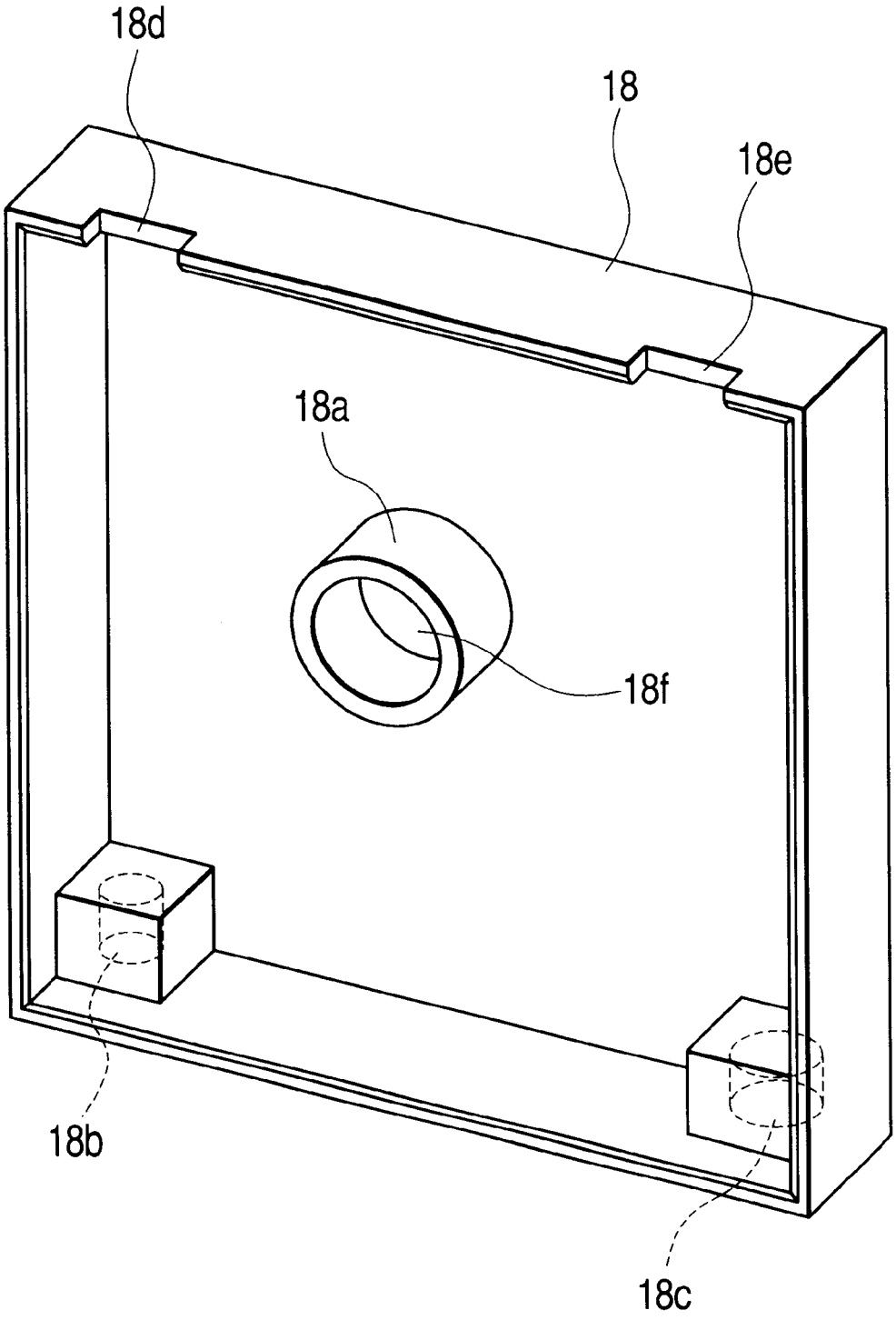
FIG. 15 is a perspective view showing a lid member in the present invention.
Figure 16:
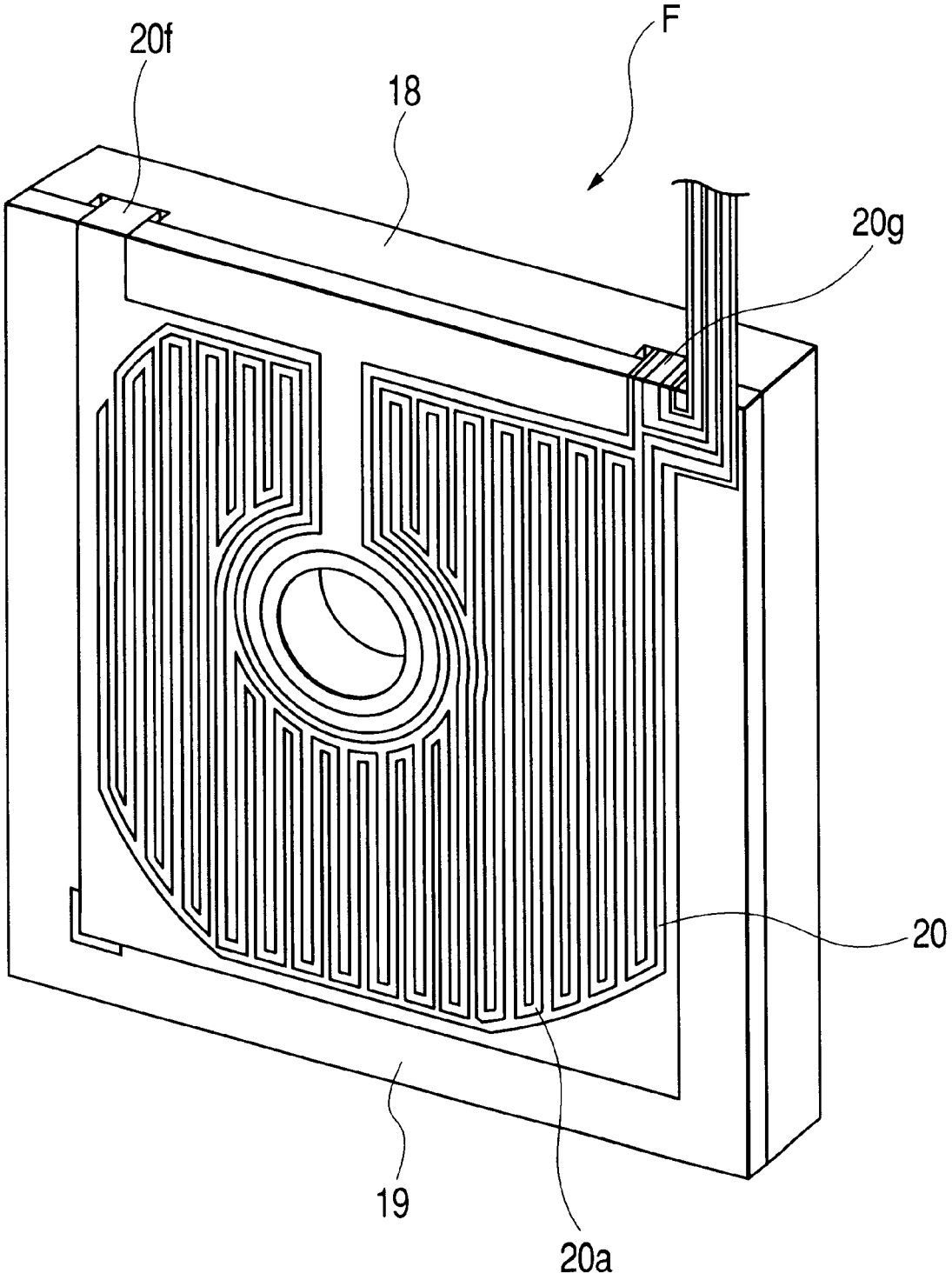
FIG. 16 is a perspective view showing a detection unit in the present invention.

The arrangement of the detection unit F having the first detection member will be described. As described above, the measurement electrode 20*a* of the first detection member is disposed at a position where it contacts the developer. In other words, the measurement electrode 20*a* faces the interior of the developer vessel. The reference electrode 20*b* in non-contact with the developer is disposed at a position where the reference electrode 20*b* does not contact the developer. For this purpose, the first embodiment adopts an adhesion member 19 which adheres the measurement electrode 20*a* and reference electrode 20*b*. As shown in FIGS. 13 and 14, the adhesion member 19 has a plate shape. The measurement electrode 20*a* is adhered to one surface 19*c* set inside the developing frame by using a reference 19*a*. Then, the first detection member 20 is bent, and the reference electrode 20*b* is adhered to the other surface 19*d* of the adhesion member 19. The adhesion member 19 is formed from a plate member, the measurement electrode 20*a* and reference electrode 20*b* are connected at two connection portions 20*f* and 20*g*, and the first detection member 20 is bent at the connection portions 20*f* and 20*g*. This decreases the inclination in adhering the reference electrode 20*b*, facilitates adhesion, and stabilizes the adhesion positions. As shown in FIGS. 15 and 16, a lid member 18 is so attached to cover the reference electrode 20*b* on the adhesion member 19 which adheres the measurement electrode 20*a* and reference electrode 20*b*. The lid member 18 having recesses 18*d* and 18*e* (see FIG. 15) which do not cover the connection portions 20*f* and 20*g* between the adhesion member 19 and the measurement electrode 20*a* and reference electrode 20*b* is used. The peripheral portion except for the connection portions 20*f* and 20*g* is welded or adhered into an integral structure. This structure can prevent toner from flowing to the reference electrode 20*b* from a portion except for the connection portions 20*f* and 20*g* (see FIG. 16).

Figure 17:
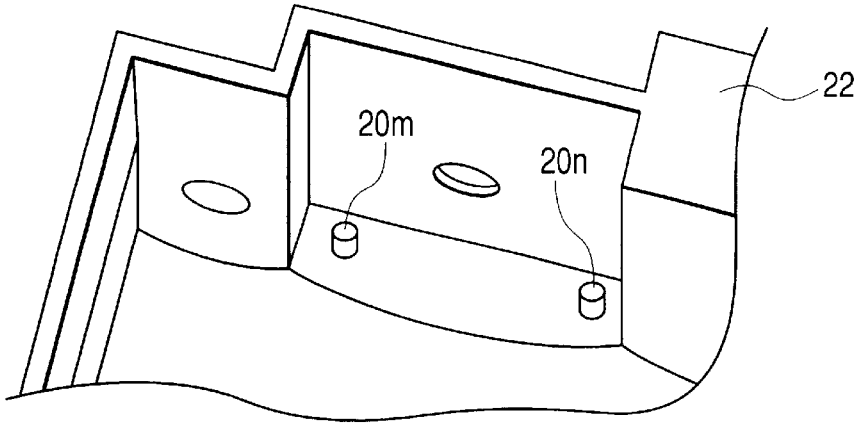
FIG. 17 is a perspective view showing the detection unit assembly portion of the developer storage vessel in the present invention.

The detection unit F having the first detection member 20 is attached to the vessel frame 22. At this time, positioning holes 18*b* and 18*c* (see FIG. 15) serving as engaging portions attached to the lid member 18 engage with positioning bosses 22*m* and 22*n* (FIG. 17) attached within the vessel frame 22, thereby positioning the detection unit F.

Figure 18:
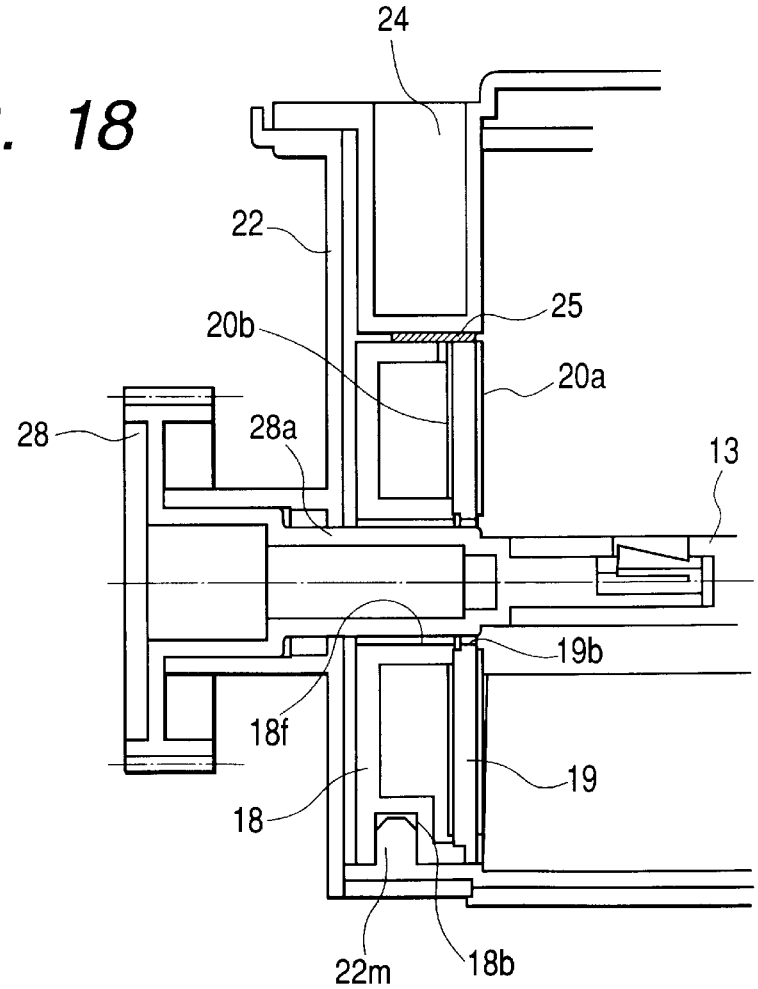
FIG. 18 is a longitudinal sectional view showing the developer vessel in the present invention.

The connection portions 20*f* and 20*g* are sealed by attaching a seal member 25 such as a light seal to the vessel lid 24 of the vessel frame 22, as shown in FIG. 8. By fixing the developer storage lid 24 to the vessel frame 22, the connection portions 20*f* and 20*g* are pressed from above by the seal member 25. This can prevent the developer from entering the reference electrode 20*b*. Holes 18*f* and 19*b* are formed at the centers of the adhesion member 19 and lid member 18. As shown in FIG. 18, the holes 18*f* and 19*b* allow a shaft 28*a* of an agitation gear 28 for driving the agitation member 13 to extend through them. As shown in FIGS. 15 and 16, a cylindrical rib 18*a* stands on the lid member 18. The rib 18*a* is fit in the large-diameter edge of the hole 19*b* of the adhesion member 19. The peripheral portion of the hole 19*b* is welded or adhered so as to fill the interval between the hole 19*b* and the rib 18*a*. Accordingly, a through hole which toner cannot enter can be formed. The agitation member 13 having the wiping member 13*b* can rotate to remove the attached developer T'.

Electrostatic Capacitance Detection Method of First Detection Member

The electrostatic capacitance detection means of the first detection member 20 will be described in detail.

Figure 21:
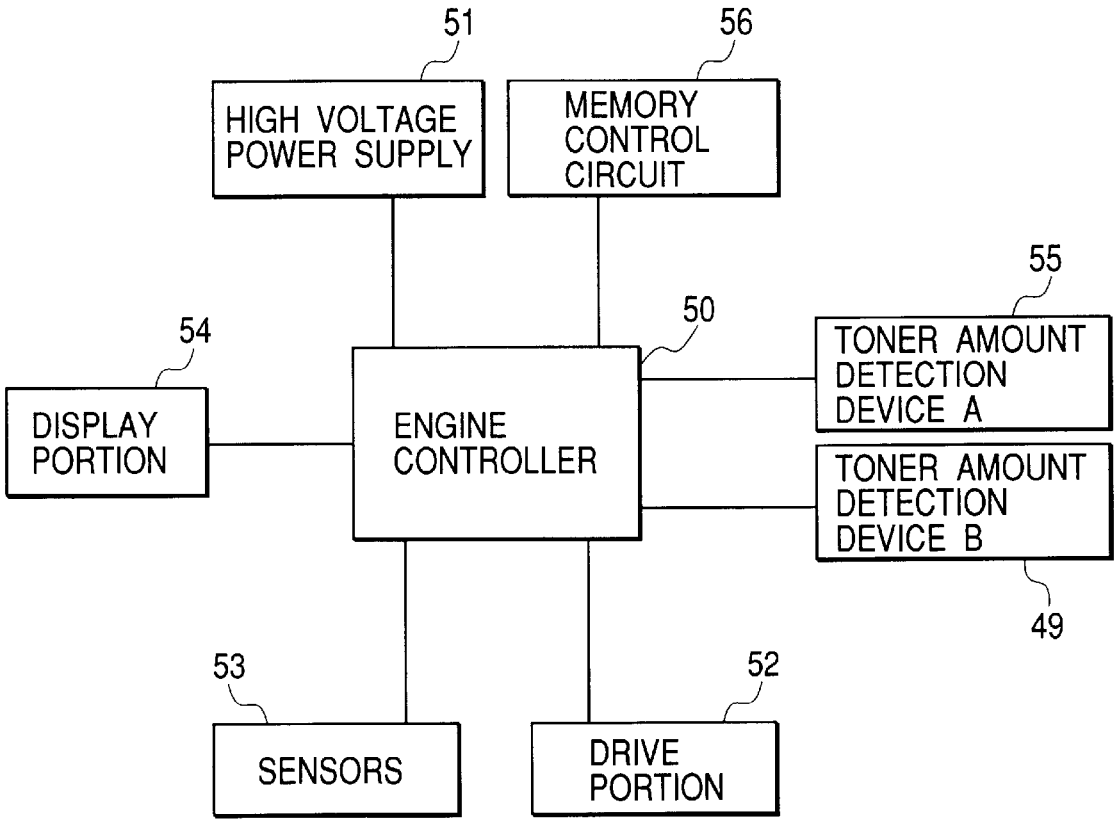
FIG. 21 is a block diagram showing the system of an image forming apparatus in the present invention.

The first detection member 20 is connected to the toner amount detection device A 55 in FIG. 21, and detects the electrostatic capacitance of the first detection member 20.

Figure 22:
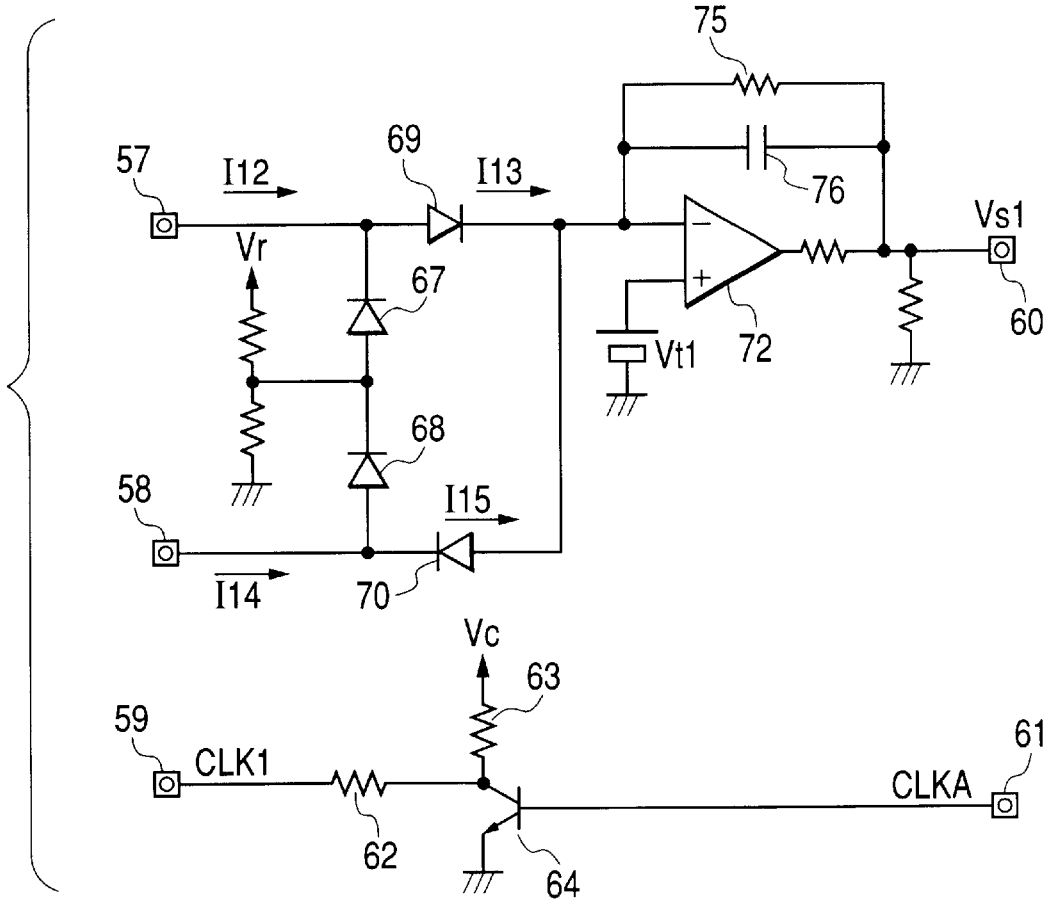
FIG. 22 is a circuit diagram showing the internal circuit of a toner amount detection device A in the present invention.

FIG. 22 is a circuit diagram showing the internal circuit of the toner amount detection device A 55.

A terminal 59 is connected to the output electrode 20*c* of the reference electrode 20*b* of the first detection member 20, and outputs toner amount detection clock 1.

Clock 1 is generated by resistors 62 and 63 and a transistor 64. A signal CLKA is a clock output from the engine controller 50, and is a rectangular wave with a frequency fc=50 kHz and Duty=50%. The clock CLKA is amplified to an amplitude=Vc by the transistor 64, and output from the terminal 59.

A terminal 57 is connected to the output electrode 20*e* of the measurement electrode 20*a* of the first detection member 20. When a clock output from the terminal 59 is applied to the electrode 20*b*, an AC current I12 flows through the terminal 57 by an electrostatic capacitance Ct between the electrodes 20*e* and 20*d*. The magnitude of the AC current I12 takes a value in accordance with the electrostatic capacitance value Ct.

The AC current I12 is rectified by diodes 69 and 67 arranged at the input portion of the terminal 57, and a rectified current I13 is input to an integrating circuit made up of an operational amplifier 72, resistor 75, and capacitor 76. The current I13 is a current of a one-way component (to be referred to as a half-wave current hereinafter) out of the components of the current I12.

A terminal 58 is connected to the common input electrode 20*d*. By a clock output from the terminal 59, a current I14 whose magnitude corresponds to an electrostatic capacitance Cr between the electrodes 20*b* and 20*d* flows through the terminal 58. The current I14 is rectified by diodes 68 and 70 set in a direction opposite to the input portion of the terminal 57, and a current I15 is input to the integrating circuit. The current I14 is a half-wave current with a polarity opposite to that of the current I13.

The currents I13 and I15 input to the integrating circuit are integrated, and a DC voltage Vd1 in accordance with the average of a total of the currents I13 and I15 is generated across the resistor 75. Letting Rs1 be the resistance value of the resistor 75, the voltage Vd1 can be approximated by $$Vd1=Rs1\times fc\times Vc\times(Ct-Cr) \quad (1)$$

The positive input of the operational amplifier 72 receives a predetermined reference voltage Vt1, and the output of the operational amplifier 72 has a characteristic represented by $$Vs1=Vt1-Rs1\times fc\times Vc\times(Ct-Cr) \quad (2)$$

As represented by equation (2), the output voltage Vs1 of the operational amplifier 72 is given by the difference between the electrostatic capacitance between the electrodes 20*e* and 20*d* on the measurement electrode side and the electrostatic capacitance between the electrodes 20*c* and 20*d* on the reference electrode side. That is, the output voltage Vs1 has a voltage value in accordance with the developer amount in the process cartridge. The output Vs1 of the operational amplifier is output from an output terminal 60.

The terminal 60 is connected to the A/D conversion terminal of the CPU in the engine controller. The voltage level Vs1 in accordance with the developer amount is converted into digital data. Further, the digital data is converted into a developer amount T1 in the process cartridge by looking up a conversion table stored in advance in the engine controller 50.

Arrangement and Layout of Second Detection Member

Figure 11:
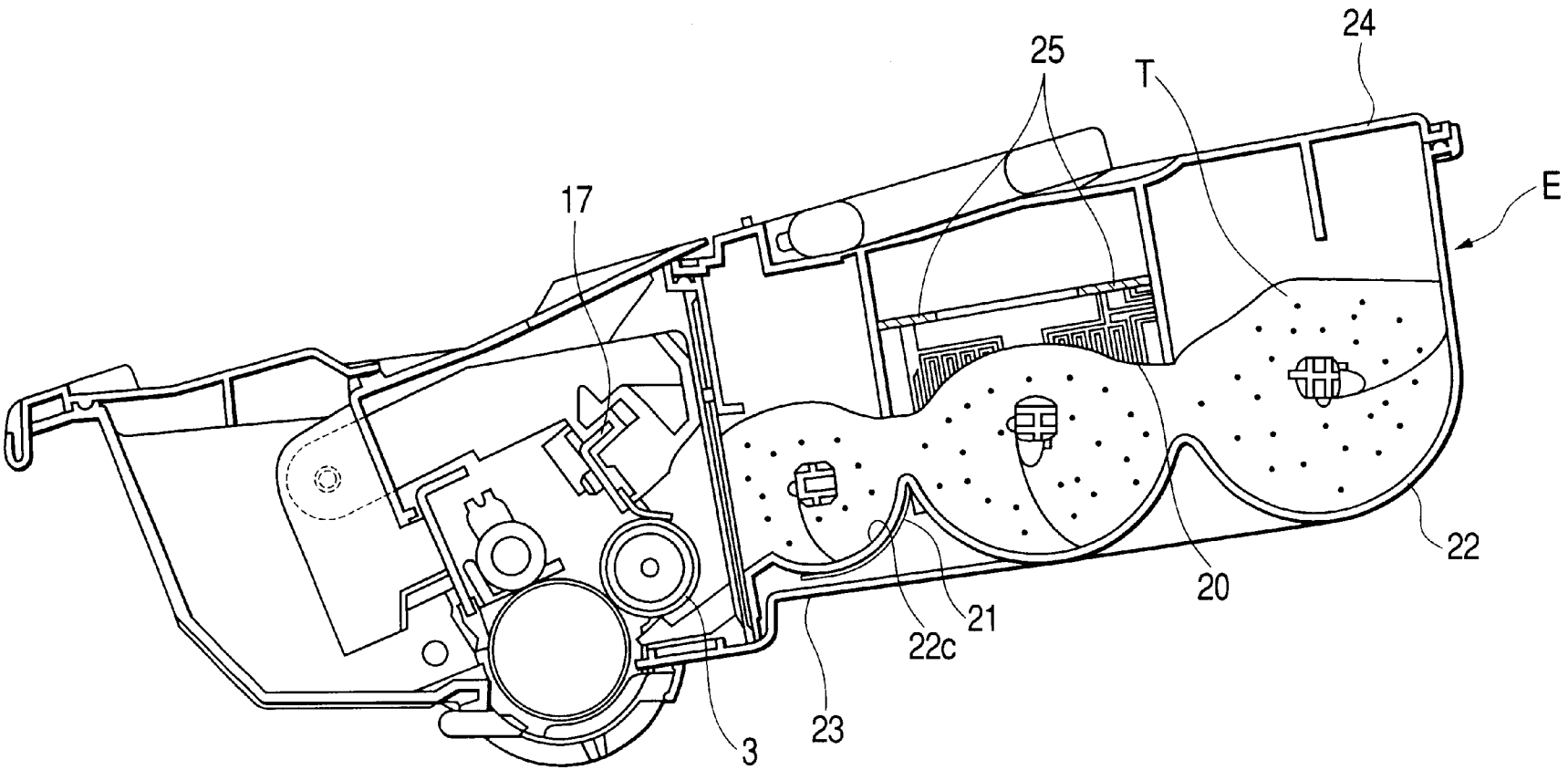
FIG. 11 is a longitudinal sectional view of the process cartridge for explaining the second detection member in the present invention.
Figure 12:
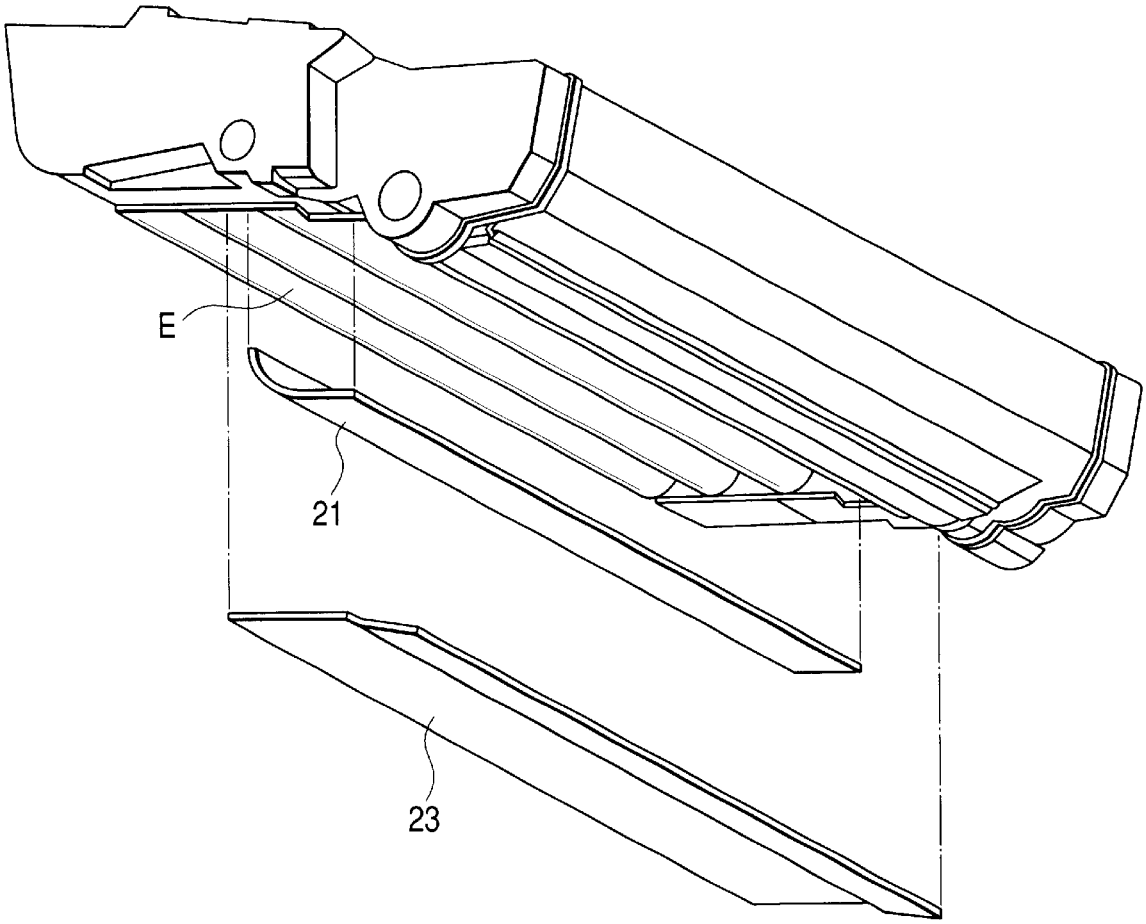
FIG. 12 is a perspective view of the process cartridge for explaining the layout location of the second detection member in the present invention when viewed from below the process cartridge.

FIG. 11 is a sectional view showing the developer vessel. FIG. 12 is a perspective view showing the developer vessel when viewed from below. The second detection member 21 is arranged outside the developer vessel E, and covered by the cover member 23. The second detection member 21 is formed from a metal plate in the longitudinal direction along the recessed shape of the bottom of the developer vessel E. The developing roller 3 and developer regulation member 17 are electrically connected to each other. A change in electrostatic capacitance between the second detection member 21, the developing roller 3, and the developer regulation member 17 is measured to detect the developer amount.

The second detection member 21 is set outside the developer vessel E, and fixed by calking, adhesion, or the like so as to be in contact with the outer surface of the recess 22*c* of the developer vessel E that is nearest to the developing roller 3. By arranging the second detection member 21 outside the developer vessel E, the wiring up to a contact where the wiring is connected to the image forming apparatus main body need not pass through the developer vessel, and the developer does not leak.

Electrostatic Capacitance Detection Method of Second Detection Member

The electrostatic capacitance detection method of the second detection member 21 will be explained in detail.

The second detection member 21 is connected to the toner amount detection device B 49 in FIG. 21. The second detection member 21 detects the electrostatic capacitance value between the second detection member 21, the developing roller 3, and developer regulation member 17.

Figure 23:
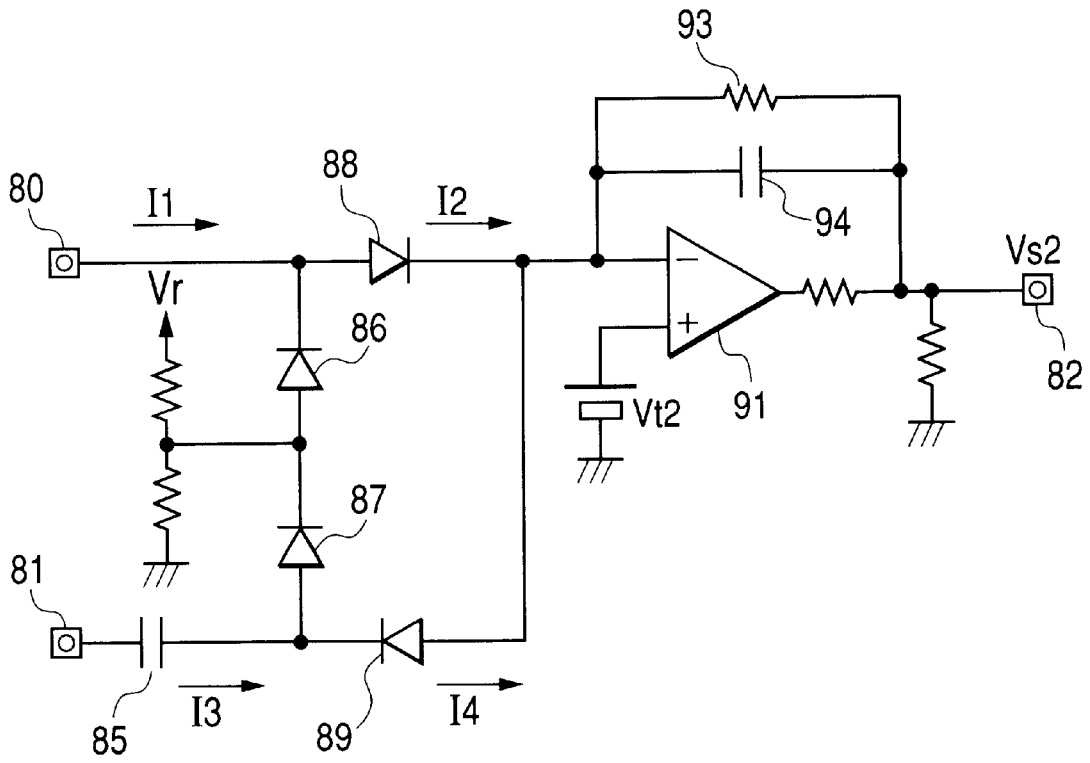
FIG. 23 is a circuit diagram showing the internal circuit of a toner amount detection device B in the present invention.

FIG. 23 is a circuit diagram showing the internal circuit of the toner amount detection device B 49.

A terminal 80 is connected to the second detection member 21. When a developing AC bias generated by the high voltage power supply 51 is applied to the developing roller 3, an AC current I1 flows through the terminal 80 due to an electrostatic capacitance Cs between the second detection member 21, the developing roller 3, and the developer regulation member 17.

The magnitude of the current I1 takes a value in accordance with the electrostatic capacitance value Cs.

The current I1 is rectified by diodes 86 and 88 arranged at the input portion of the terminal 80, and a rectified current I2 is input to an integrating circuit made up of an operational amplifier 91, resistor 93, and capacitor 94. The current I2 is a half-wave current of the current I1.

A terminal 81 is connected to a developing bias output portion (not shown) within the high voltage power supply 51. That is, the terminal 81 receives the same developing bias as that to the developing roller 3.

The input portion of the terminal 81 is connected to a capacitor 85 having an electrostatic capacitance Ck. Upon application of a developing AC bias, an AC current I3 whose magnitude corresponds to the electrostatic capacitance Ck flows. The capacitor 85 is a reference capacitor serving as a measurement reference. The electrostatic capacitance value Ck is set to an electrostatic capacitance value between the second detection member 21, the developing roller 3, and the developer regulation member 17 in the absence of any developer in the process cartridge.

The current I3 is rectified by diodes 87 and 89 set in a direction opposite to that of the input portion of the terminal 81, and a current I4 is input to the integrating circuit. The current I4 is a half-wave current with a polarity opposite to that of the current I2.

The currents I2 and I4 input to the integrating circuit are integrated, and a DC voltage Vd2 in accordance with the average of a total of the currents I2 and I4 is generated across the resistor 93. Letting fd be the frequency of the developing AC bias, Vp be the amplitude, and Rs2 be the resistance value of the resistor 93, the voltage Vd2 can be approximated by $$Vd2=Rs2\times fd\times Vp\times(Cs-Ck) \quad (3)$$

The noninverting input terminal of the operational amplifier 91 receives a predetermined reference voltage Vt2, and the output of the operational amplifier 91 has a characteristic represented by $$Vs2=Vt2-Rs2\times fd\times Vp\times(Cs-Ck) \quad (4)$$

As represented by equation (4), the output voltage Vs2 of the operational amplifier is given by the difference between the electrostatic capacitance between the second detection member 21, the developing roller 3, and the developer regulation member 17, and the electrostatic capacitance of the reference capacitor 85. That is, the output voltage Vs2 has a voltage value in accordance with the developer amount in the process cartridge. The output Vs2 of the operational amplifier is output from an output terminal 82.

The terminal 82 is connected to the A/D conversion terminal of the CPU in the engine controller. The voltage level Vs2 in accordance with the developer amount is converted into digital data. Further, the digital data is converted into a developer amount T2 in the process cartridge by looking up a conversion table stored in advance in the engine controller 50.

The developer amount T1 detected by the first detection member 20 and the developer amount T2 detected by the second detection member 21 are compared inside the engine controller 50. The value of the developer amount T1 or T2 is displayed on the display portion 54 and notified to the user. The detection value of the detected developer amount is stored in the memory unit 100 in the process cartridge.

With the above arrangement, the detection unit F having the first detection member 20 is integrated. Deposition of toner on the reference electrode side can be prevented, and the developer amount can be accurately detected. Layout in the developer storage vessel is facilitated, and the assembly precision is increased.

Second Embodiment

The second embodiment relates to the arrangement of the detection unit in the first embodiment.

Arrangement of Detection Unit

Figure 19:
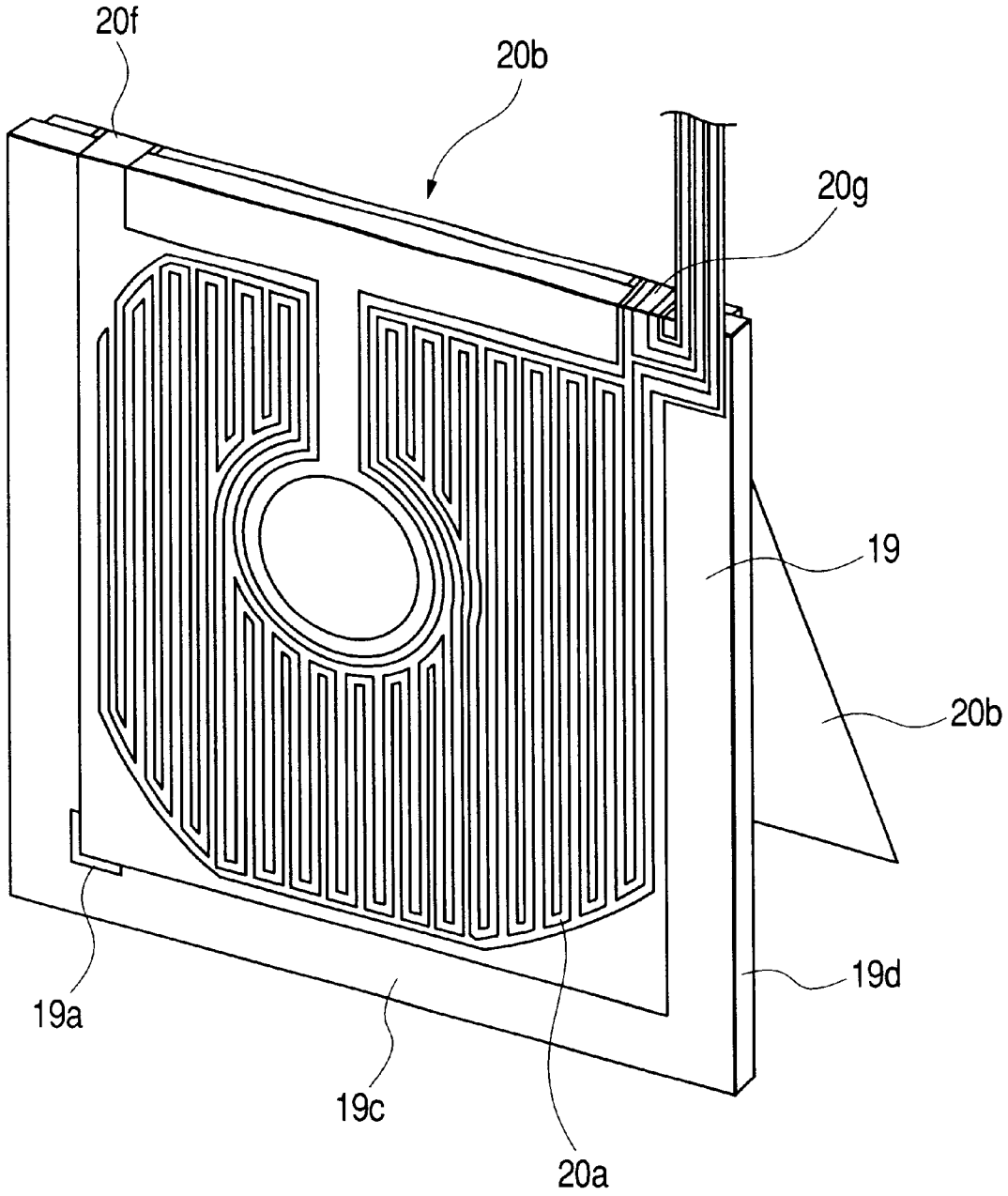
FIG. 19 is a perspective view showing the second embodiment.
Figure 20:
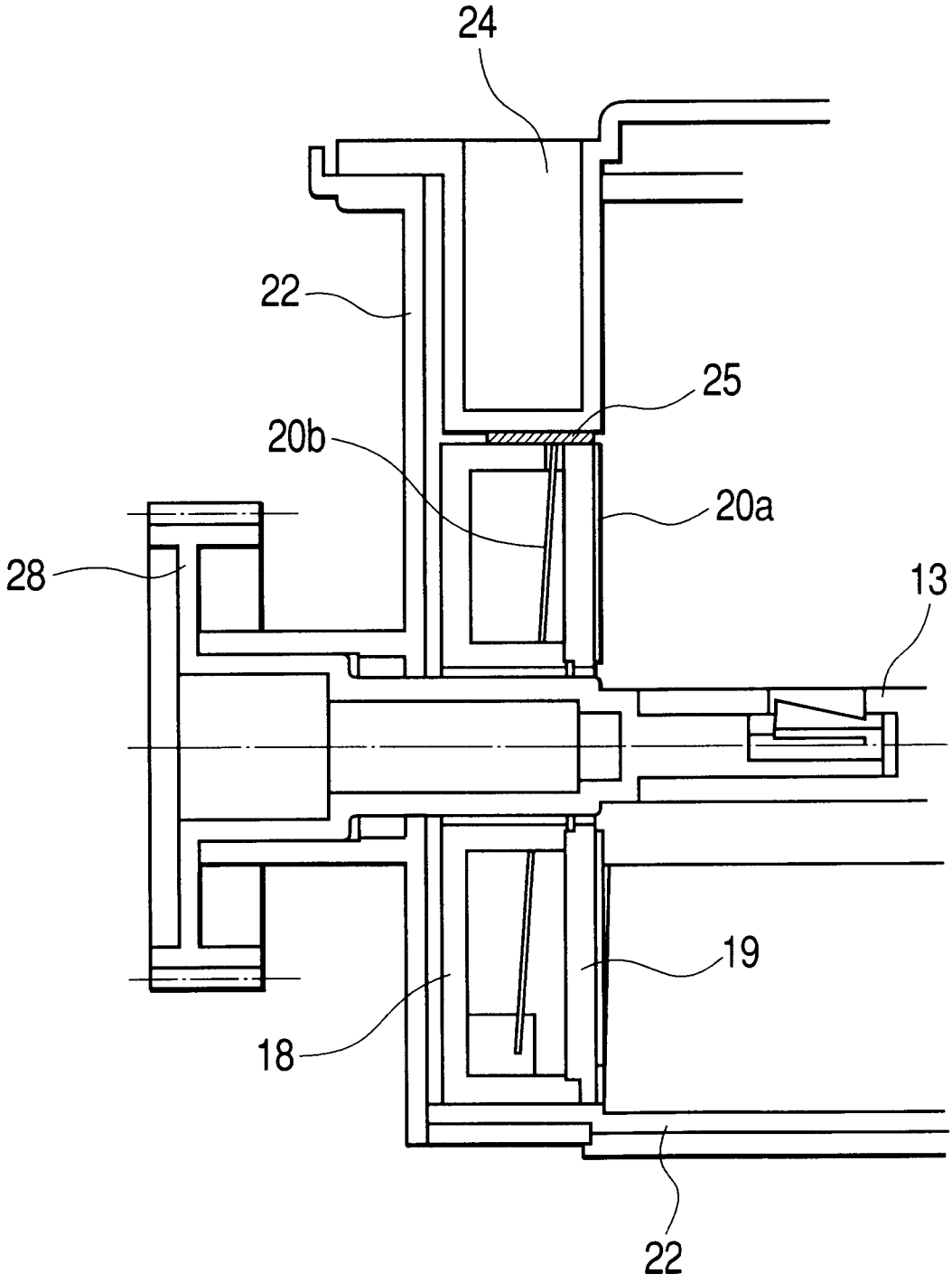
FIG. 20 is a longitudinal sectional view showing the second embodiment.

A measurement electrode 20*a* of a first detection member is disposed at a position where it contacts the developer. In other words, the measurement electrode 20*a* faces the interior of the developer vessel. A reference electrode 20*b* in non-contact with the developer is disposed at a position where the reference electrode 20*b* does not contact the developer. As shown in FIG. 19, the measurement electrode 20*a* is adhered along a reference 19*a* on a surface 19*c* of an adhesion member 19 that is set inside the developer storage vessel. Similar to the first embodiment, a lid member 18 is welded without adhering the reference electrode 20*b* to the other surface 19*d* of the adhesion member 19. The resultant structure is arranged in a vessel frame 22. As shown in FIG. 20, a seal member 25 such as a light seal is adhered and fixed to a vessel lid 24. Connection portions are pressed from above them by the seal member 25 to seal the structure. This can prevent the developer from entering the reference electrode 20*b*.

In this arrangement, only the measurement electrode 20*a* of the first detection member 20 is adhered without adhering the reference electrode 20*b*. The number of assembly steps of the first detection member 20 to the adhesion member 19 can be decreased.

Although the embodiment has exemplified the process cartridge, the present invention is applied a developing cartridge which is constituted by integrating a developing member and developer storage vessel and is detachably attachable to the apparatus main body, and a developer vessel which is detachably attachable to the apparatus main body, is installed in the apparatus main body, and supplies a developer to a detachable developing member.

Adhesion Surface of First Detection Member

Third Embodiment

Figure 26:
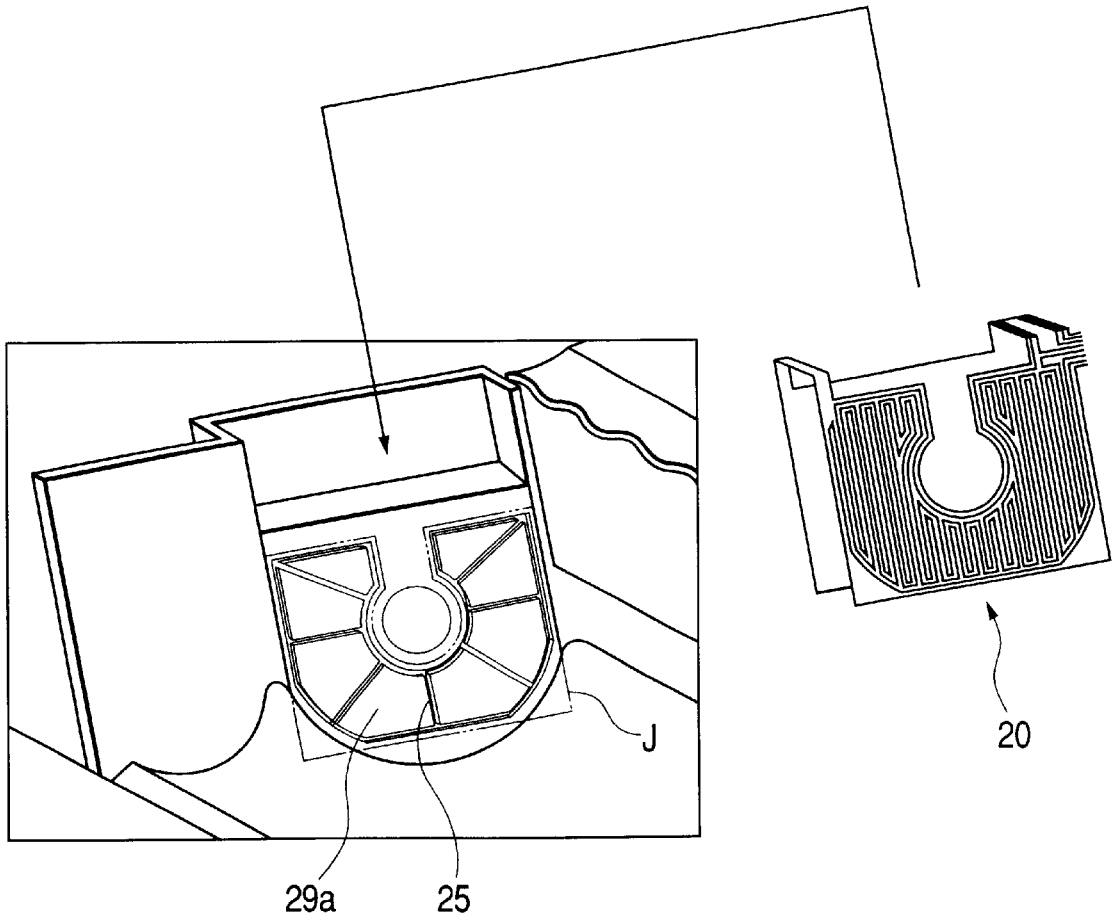
FIG. 26 is a perspective view showing the adhesion surface in the present invention.

FIG. 26 shows a detection member adhesion surface in the third embodiment. In FIG. 26, a first detection member 20 as a flexible printed circuit is set in a region surrounded by a chain double-dashed line J.

Figure 27:
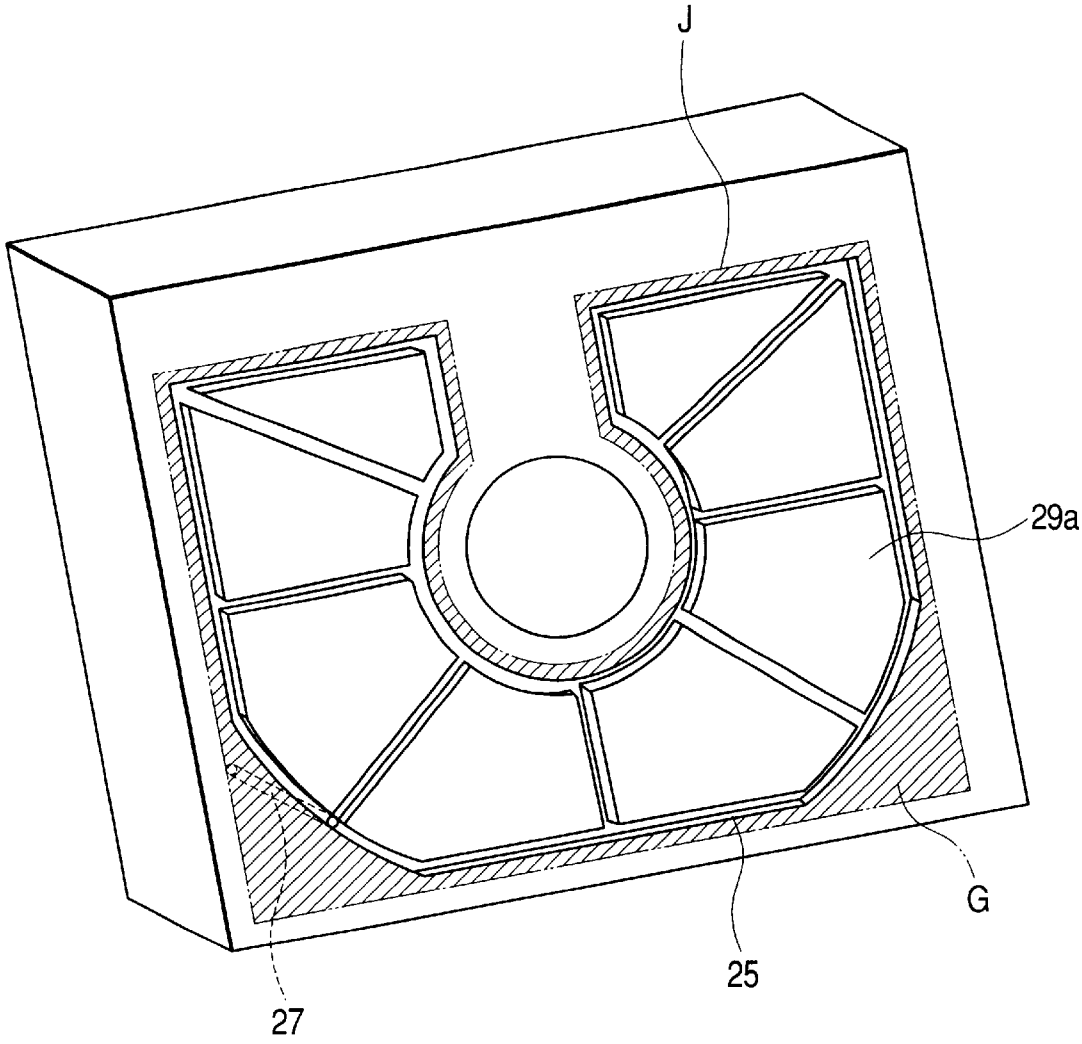
FIG. 27 is a perspective view showing the adhesion surface in the present invention.
Figure 28:
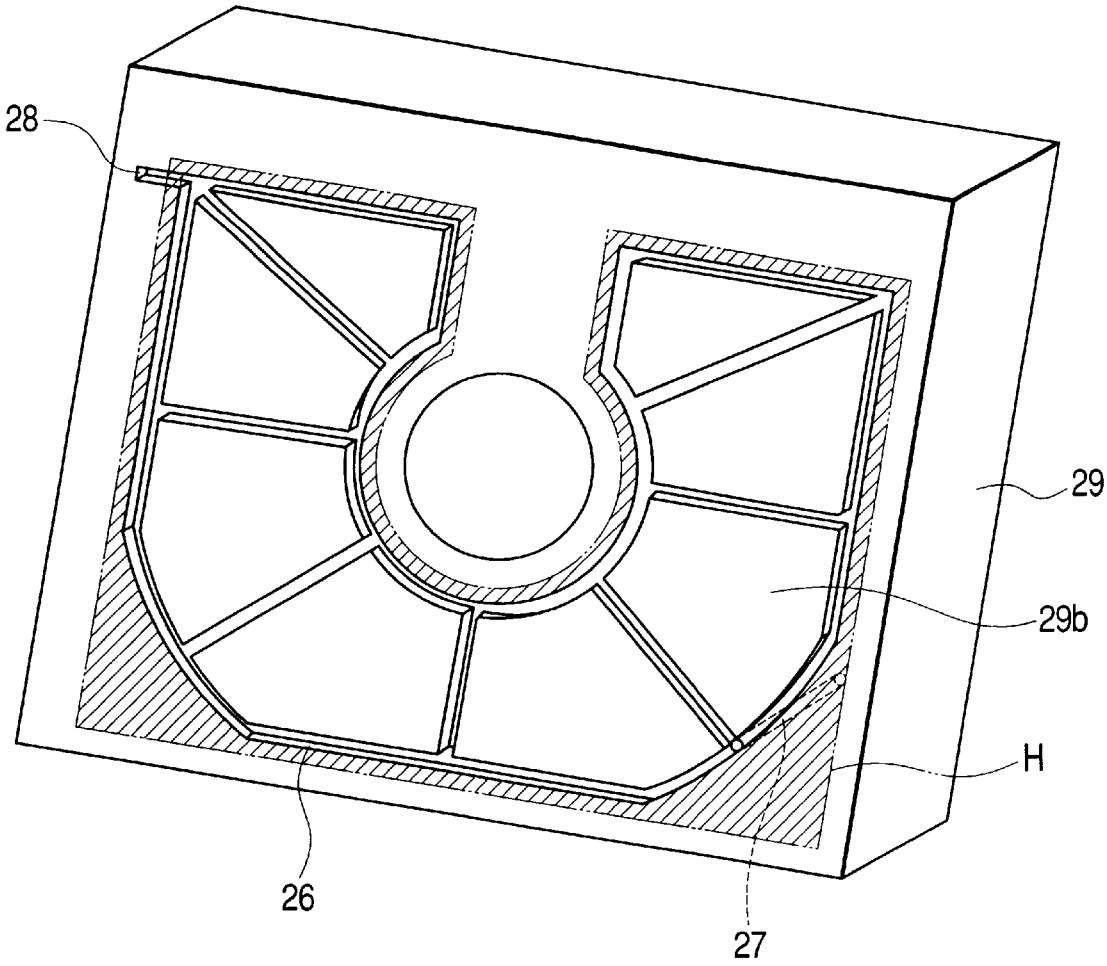
FIG. 28 is a perspective view showing the adhesion surface in the present invention.

FIGS. 27 and 28 are enlarged views showing the detection member adhesion surface in the third embodiment.

FIG. 27 shows an adhesion surface 29*a* for a measurement electrode 20*a*. FIG. 28 shows an adhesion surface 29*b* for a reference electrode 20*b*. In FIG. 27, a first groove 25 is formed within a region J surrounded by a chain line by boring the adhesion surface 29*a*. The groove 25 is a linear groove. The first groove 25 is formed into circles at a proper interval in the adhesion surface 29*a*, and all the circles are coupled to each other. The first groove 25 is coupled to a second groove 26 formed in the adhesion surface 29*b* for the reference electrode 20*b* via a through hole 27 formed in part of the first groove 25. A hatched circumferential region G of the measurement electrode 20*a* is fixed with a double-coated tape, adhesive, or the like, and the developer T does not enter the first groove 25. FIG. 28 shows the adhesion surface 29*b* for the reference electrode 20*b*. Similar to the first groove 25, the second groove 26 is formed by boring the adhesion surface. The second groove 26 is also formed into circles at a proper interval on the adhesion surface 29*b*, and all the circles are coupled to each other. The groove 26 is a linear groove. As for the groove shape, patterns as the figures of the first and second grooves 25 and 26 are desirably almost symmetrical to make the grooves 25 and 26 overlap each other in order to suppress variations in electrostatic capacitance. That is, patterns on the adhesion surfaces 29*a* and 29*b* for the grooves 25 and 26 are almost identical. Also, the regions G and H using the adhesive are desirably almost symmetrical. With this arrangement, the adhesion conditions of the measurement electrode 20*a* and reference electrode 20*b* become almost the same. The developer amount in accordance with the electrostatic capacitance can be more accurately detected. A projection 28 is formed to the second groove 26 outside the chain line region. The projection 28 also has a groove-like section, and extends outside the region H. The first and second grooves 25 and 26 and the through hole 27 communicate with air via the projection 28.

Figure 29:
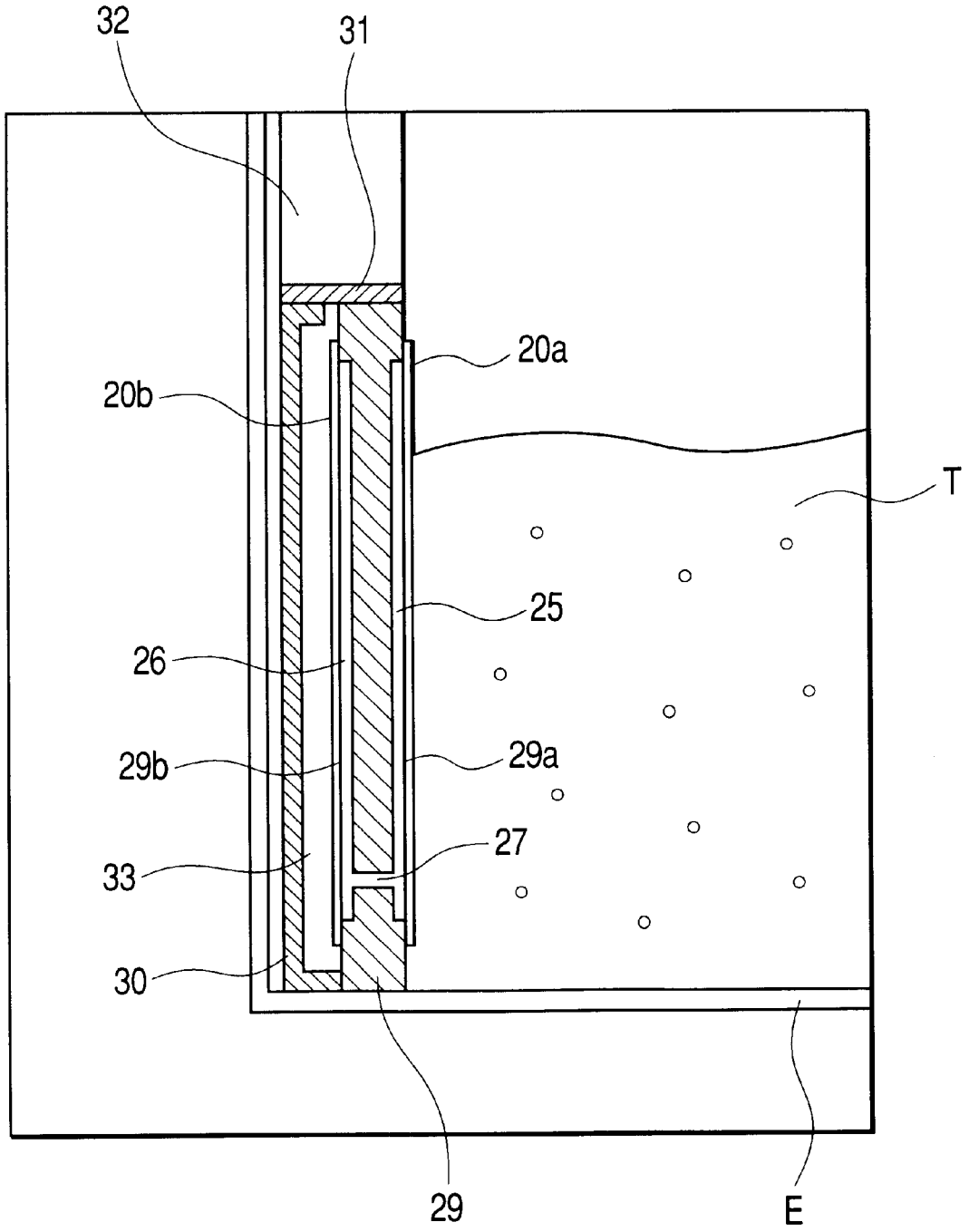
FIG. 29 is a longitudinal sectional view when the detection member is assembled in the present invention.

FIG. 29 is a sectional view when the detection member is assembled. The measurement electrode 20*a* and reference electrode 20*b* are so arranged as to cover the first and second grooves 25 and 26. The measurement electrode 20*a* is disposed at a position where it contacts the toner T, whereas the reference electrode 20*b* is disposed at a position where it does not contact the toner T. The grooves 25 and 26 are formed in a plate 29 which holds the measurement electrode 20*a* and reference electrode 20*b*. The plate 29 and a reference electrode protection member 30 are fixed at their peripheral portions by welding, adhesion, and the like. An opening is formed at an upper portion in a space 33 where the reference electrode 20*b* is set, and is closed with a foamed seal member 31. The seal member 31 is pressed from above it by a fixing member 32 to prevent the developer from entering the space 33 via the opening though air can enter the space 33.

Air in the space 33 can enter the second groove 26 via the projection 28 in FIG. 28. Air also enters the first groove 25 via the through hole 27. Since the projection 28 is located at a position where it does not contact the toner T, the toner T does not enter the space 33 via the projection 28. This arrangement allows air to enter the grooved portion, thereby preventing confinement of bubbles. The groove is formed along the outer shape of the measurement electrode 20*a* to decrease the adhesion area so as not to float the peripheral portion. As a result, the toner cannot enter the first groove 25. Forming the groove into circles in the adhesion surface can decrease the possibility of generating bubbles.

The measurement electrode 20*a* and reference electrode 20*b* can be reliably adhered to the plate 29, and the developer amount in accordance with the electrostatic capacitance can be accurately detected, as described above.

Fourth Embodiment

Figure 30:
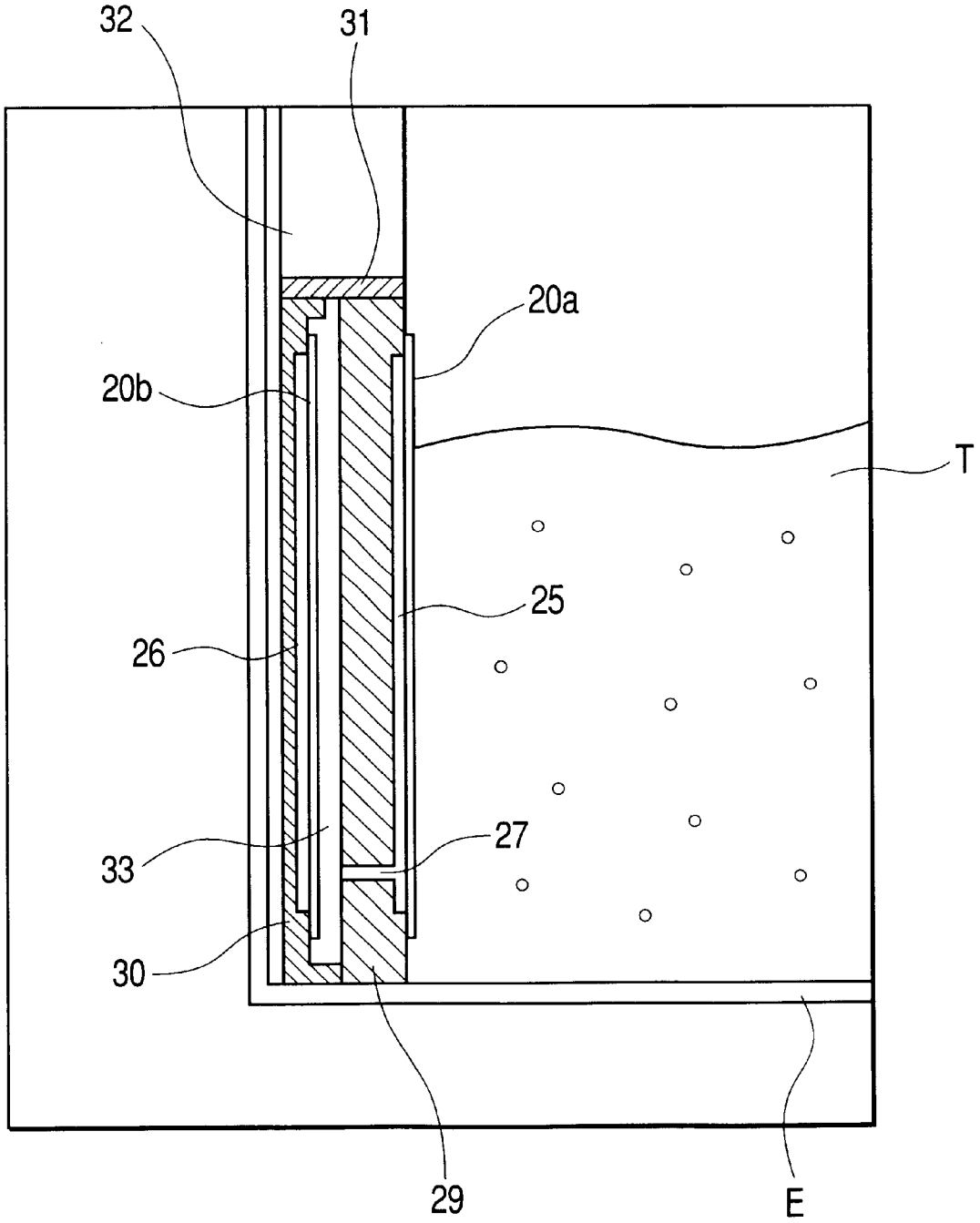
FIG. 30 is a longitudinal sectional view when the detection member is assembled in the present invention.

FIG. 30 is a sectional view showing a reference electrode adhesion surface according to the fourth embodiment.

Although the layout of a measurement electrode 20*a* is the same as that of the third embodiment, a reference electrode 20*b* is adhered to a reference electrode protection member 30. A first detection member 20 is formed from a flexible board, which enables laying out the measurement electrode 20*a* and reference electrode 20*b* in this way. The shapes of grooves 25 and 26 and the positional relationship between the grooves 25 and 26 and the detection member are the same as those of the fourth embodiment. In this case, the same effects can be obtained.

Fifth Embodiment

Figure 31:
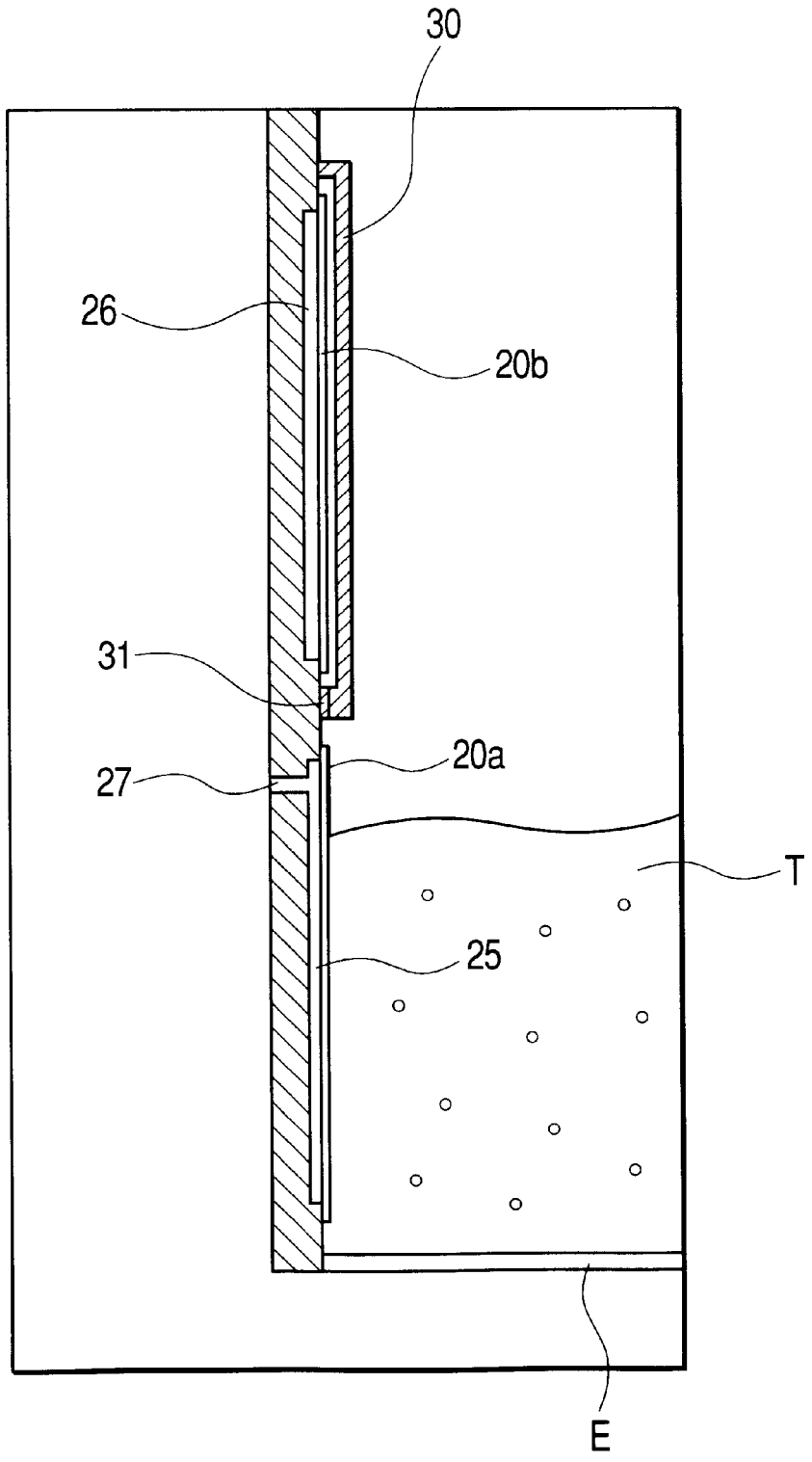
FIG. 31 is a longitudinal sectional view when the detection member is assembled in the present invention.

FIG. 31 is a sectional view showing an adhesion surface for a reference electrode 20*b* according to the fifth embodiment.

Although the layout of a measurement electrode 20*a* is the same as that of the fourth embodiment, the reference electrode 20*b* is adhered to the same surface as that for the measurement electrode 20*a*. At this time, the inner surface of a developer vessel E may be used as an adhesion surface. The remaining arrangement is the same as that of the first embodiment. This arrangement can shorten the width of the developer vessel and downsize the apparatus.

In this arrangement, a detection member 20, first groove 25, and second groove 26 are disposed, thereby reducing variations in the electrostatic capacitance of the detection member and increasing the detection precision.

Although the embodiment has exemplified the process cartridge, the present invention is also applied a developing cartridge which has a developing member for developing an electrostatic latent image formed on a photosensitive drum by using a developer, and a developer vessel that stores the developer to be supplied to the developing member, and an electrophotographic image forming apparatus to which the developing cartridge is detachably attachable. This developing cartridge is constituted by attaching a guide member for mounting on the apparatus main body to a developing unit obtained by joining a vessel frame 22 and a developing frame 11 which supports a developing roller 3.

As has been described above, the present invention can more accurately detect the residual amount of developer.

The present invention can prevent the developer from attaching to the reference electrode member, and more accurately detect the residual amount of developer in the developer vessel.

The present invention can reliably adhere the measurement electrode member to the adhesion member, and more accurately detect the residual amount of developer in the developer vessel.

The present invention can reliably adhere the reference electrode member to the adhesion member, and more accurately detect the residual amount of developer in the developer vessel.

The present invention can easily position the detection unit with respect to the developer vessel, and increase the assembly precision.

What is claimed is:

1. A detection unit for outputting an electrical signal in accordance with an electrostatic capacitance to an apparatus main body in order to detect a residual amount of developer in a developer vessel by an electrophotographic image forming apparatus main body, comprising:

a measurement electrode member which is arranged at a position where said measurement electrode member contacts the developer when mounted in the developer vessel, has at least a pair of portions parallel to each other at a predetermined interval, and has an input electrode for receiving a voltage from the apparatus main body and an output electrode for outputting an electrical signal in accordance with an electrostatic capacitance generated upon application of the voltage;

a reference electrode member which is arranged at a position where said reference electrode member does not contact the developer when mounted in the developer vessel, has at least a pair of portions parallel to each other at a predetermined interval, and has an input electrode for receiving a voltage from the apparatus main body and an output electrode for outputting an electrical signal in accordance with an electrostatic capacitance generated upon application of the voltage;

an adhesion member to which said measurement electrode member is adhered;

a lid member which is coupled to said adhesion member and covers said reference electrode member interposed between said adhesion member and said lid member; and an engaging portion which engages with a vessel positioning portion attached to the developer vessel when said detection unit is attached to the developer vessel, and positions said detection unit with respect to the developer vessel.

2. A unit according to claim 1, wherein said measurement electrode member and said reference electrode member include flexible boards.

3. A unit according to claim 1 or 2, wherein said reference electrode member is adhered to a surface of said adhesion member opposite to a surface to which said measurement electrode member is adhered.

4. A unit according to claim 1 or 2, wherein said adhesion member has a passage which lets air escape so as not to seal air between said adhesion member and said measurement electrode member when said measurement electrode member is adhered.

5. A unit according to claim 3, wherein said adhesion member has a passage which lets air escape so as not to seal air between said adhesion member and said measurement electrode member when said reference electrode member is adhered.

6. A developer vessel which stores a developer to be supplied to a developing member for developing an electrostatic latent image formed on an electrophotographic photosensitive member, comprising:

a developer storage portion;

a vessel positioning member; and a detection unit for outputting an electrical signal in accordance with an electrostatic capacitance to an apparatus main body in order to detect a residual amount of developer in said developer vessel by an electrophotographic image forming apparatus main body, said detection unit having a measurement electrode member which is arranged at a position where said measurement electrode member contacts the developer when mounted in said developer vessel, has at least a pair of portions parallel to each other at a predetermined interval, and has an input electrode for receiving a voltage from the apparatus main body and an output electrode for outputting an electrical signal in accordance with an electrostatic capacitance generated upon application of the voltage, a reference electrode member which is arranged at a position where said reference electrode member does not contact the developer when mounted in said developer vessel, has at least a pair of portions parallel to each other at a predetermined interval, and has an input electrode for receiving a voltage from the apparatus main body and an output electrode for outputting an electrical signal in accordance with an electrostatic capacitance generated upon application of the voltage, an adhesion member to which said measurement electrode member is adhered, a lid member which is coupled to said adhesion member and covers said reference electrode member interposed between said adhesion member and said lid member, and an engaging portion which engages with said vessel positioning member when said detection unit is attached to said developer vessel, and positions said detection unit with respect to said developer vessel.

7. A vessel according to claim 6, wherein said measurement electrode member and said reference electrode member include flexible boards.

8. A vessel according to claim 6 or 7, wherein said reference electrode member is adhered to a surface of said adhesion member opposite to a surface to which said measurement electrode member is adhered.

9. A vessel according to claim 6 or 7, wherein said adhesion member has a passage which lets air escape so as not to seal air between said adhesion member and said measurement electrode member when said measurement electrode member is adhered.

10. A vessel according to claim 8, wherein said adhesion member has a passage which lets air escape so as not to seal air between said adhesion member and said measurement electrode member when said reference electrode member is adhered.

11. A vessel according to claim 6, wherein said developer vessel further comprises developer removal means for removing a developer deposited in a detection region of said measurement electrode member.

12. A process cartridge detachably attachable to an electrophotographic image forming apparatus main body, comprising:

an electrophotographic photosensitive member;

a developing member which develops an electrostatic latent image formed on said electrophotographic photosensitive member with a developer; and a developer vessel which stores a developer to be supplied to said developing member, said developer vessel having a developer storage portion, a positioning member, and a detection unit for outputting an electrical signal in accordance with an electrostatic capacitance to the apparatus main body in order to detect a residual amount of developer in said developer vessel by the apparatus main body, said detection unit having a measurement electrode member which is arranged at a position where said measurement electrode member contacts the developer when mounted in said developer vessel, has at least a pair of portions parallel to each other at a predetermined interval, and has an input electrode for receiving a voltage from the apparatus main body and an output electrode for outputting an electrical signal in accordance with an electrostatic capacitance generated upon application of the voltage, a reference electrode member which is arranged at a position where said reference electrode member does not contact the developer when mounted in said developer vessel, has at least a pair of portions parallel to each other at a predetermined interval, and has an input electrode for receiving a voltage from the apparatus main body and an output electrode for outputting an electrical signal in accordance with an electrostatic capacitance generated upon application of the voltage, an adhesion member to which said measurement electrode member is adhered, a lid member which is coupled to said adhesion member and covers said reference electrode member interposed between said adhesion member and said lid member, and an engaging portion which engages with said vessel positioning member when said detection unit is attached to said developer vessel, and positions said detection unit with respect to said developer vessel.

13. A cartridge according to claim 12, wherein said measurement electrode member and said reference electrode member include flexible boards.

14. A cartridge according to claim 12 or 13, wherein said reference electrode member is adhered to a surface of said adhesion member opposite to a surface to which said measurement electrode member is adhered.

15. A cartridge according to claim 12 or 13, wherein said adhesion member has a passage which lets air escape so as not to seal air between said adhesion member and said measurement electrode member when said measurement electrode member is adhered.

16. A cartridge according to claim 14, wherein said adhesion member has a passage which lets air escape so as not to seal air between said adhesion member and said measurement electrode member when said reference electrode member is adhered.

17. A cartridge according to claim 12, wherein said developer vessel comprises developer removal means for removing a developer deposited in a detection region of said measurement electrode member.

18. A process cartridge detachably attachable to an electrophotographic image forming apparatus main body, comprising:

an electrophotographic photosensitive member;

a developing member which develops an electrostatic latent image formed on said electrophotographic photosensitive member with a developer; and a developer vessel which stores a developer to be supplied to said developing member, said developer vessel having a developer storage portion, a positioning member, and a detection unit for outputting an electrical signal in accordance with an electrostatic capacitance to the apparatus main body in order to detect a residual amount of developer in said developer vessel by the apparatus main body, said detection unit having a measurement electrode member which is arranged at a position where said measurement electrode member contacts the developer when mounted in said developer vessel, has at least a pair of portions parallel to each other at a predetermined interval, and has an input electrode for receiving a voltage from the apparatus main body and an output electrode for outputting an electrical signal in accordance with an electrostatic capacitance generated upon application of the voltage, a reference electrode member which is arranged at a position where said reference electrode member does not contact the developer when mounted in said developer vessel, has at least a pair of portions parallel to each other at a predetermined interval, and has an input electrode for receiving a voltage from the apparatus main body and an output electrode for outputting an electrical signal in accordance with an electrostatic capacitance generated upon application of the voltage, an adhesion member to which said measurement electrode member and said reference electrode member are adhered, said reference electrode member being adhered to a surface opposite to a surface to which said measurement electrode member is adhered, a passage which is formed in said adhesion member and lets air escape so as not to seal air between said adhesion member and said measurement electrode member and between said adhesion member and said reference electrode member when said measurement electrode member and said reference electrode member are adhered, a lid member which is coupled to said adhesion member and covers said reference electrode member interposed between said adhesion member and said lid member, and an engaging portion which engages with said vessel positioning member when said detection unit is attached to said developer vessel, and positions said detection unit with respect to said developer vessel.

19. A developing cartridge detachably attachable to an electrophotographic image forming apparatus main body, comprising:

a developing member which develops an electrostatic latent image formed on an electrophotographic photosensitive member with a developer; and a developer vessel which stores a developer to be supplied to said developing member, said developer vessel having a developer storage portion, a positioning member, and a detection unit for outputting an electrical signal in accordance with an electrostatic capacitance to the apparatus main body in order to detect a residual amount of developer in said developer vessel by the apparatus main body, said detection unit having a measurement electrode member which is arranged at a position where said measurement electrode member contacts the developer when mounted in said developer vessel, has at least a pair of portions parallel to each other at a predetermined interval, and has an input electrode for receiving a voltage from the apparatus main body and an output electrode for outputting an electrical signal in accordance with an electrostatic capacitance generated upon application of the voltage, a reference electrode member which is arranged at a position where said reference electrode member does not contact the developer when mounted in said developer vessel, has at least a pair of portions parallel to each other at a predetermined interval, and has an input electrode for receiving a voltage from the apparatus main body and an output electrode for outputting an electrical signal in accordance with an electrostatic capacitance generated upon application of the voltage, an adhesion member to which said measurement electrode member is adhered, a lid member which is coupled to said adhesion member and covers said reference electrode member interposed between said adhesion member and said lid member, and an engaging portion which engages with said vessel positioning member when said detection unit is attached to said developer vessel, and positions said detection unit with respect to said developer vessel.

20. An electrophotographic image forming apparatus which allows detachably attaching a process cartridge and forms an image on a recording medium, comprising:

(a) mounting means for detachably mounting said process cartridge, said process cartridge having an electrophotographic photosensitive member, a developing member which develops an electrostatic latent image formed on said electrophotographic photosensitive member with a developer, and a developer vessel which stores a developer to be supplied to said developing member, said developer vessel having a developer storage portion, a positioning member, and a detection unit for outputting an electrical signal in accordance with an electrostatic capacitance to the apparatus main body in order to detect a residual amount of developer in said developer vessel by the apparatus main body, said detection unit having a measurement electrode member which is arranged at a position where said measurement electrode member contacts the developer when mounted in said developer vessel, has at least a pair of portions parallel to each other at a predetermined interval, and has an input electrode for receiving a voltage from the apparatus main body and an output electrode for outputting an electrical signal in accordance with an electrostatic capacitance generated upon application of the voltage, a reference electrode member which is arranged at a position where said reference electrode member does not contact the developer when mounted in said developer vessel, has at least a pair of portions parallel to each other at a predetermined interval, and has an input electrode for receiving a voltage from the apparatus main body and an output electrode for outputting an electrical signal in accordance with an electrostatic capacitance generated upon application of the voltage, an adhesion member to which said measurement electrode member is adhered, a lid member which is coupled to said adhesion member and covers said reference electrode member interposed between said adhesion member and said lid member, and an engaging portion which engages with said vessel positioning member when said detection unit is attached to said developer vessel, and positions said detection unit with respect to said developer vessel; and (b) convey means for conveying the recording medium.

* * * * *